US010212784B2

(12) United States Patent
Middleton-White et al.

(10) Patent No.: US 10,212,784 B2
(45) **Date of Patent: *Feb. 19, 2019**

(54) INTEGRATED LIGHTING SYSTEM AND METHOD

(71) Applicant: Hubbell Incorporated, Shelton, CT (US)

(72) Inventors: Stuart Middleton-White, Austin, TX (US); Gregory Smith, San Antonio, TX (US); Robert Martin, Pflugerville, TX (US); Thomas J. Hartnagel, Taylor, TX (US); Theodore Eric Weber, Round Rock, TX (US); Mike Crane, Round Rock, TX (US); Terry Arbouw, Georgetown, TX (US); Dawn R. Kack, Landrum, SC (US); David J. Rector, Mauldin, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/865,665

(22) Filed: Jan. 9, 2018

(65) Prior Publication Data

US 2018/0132334 A1 May 10, 2018

Related U.S. Application Data

(63) Continuation of application No. 14/715,315, filed on May 18, 2015, now Pat. No. 9,877,373, which is a (Continued)

(51) Int. Cl.
*H05B 33/08* (2006.01)
*H05B 37/02* (2006.01)

(52) U.S. Cl.
CPC ..... *H05B 37/0209* (2013.01); *H05B 37/02* (2013.01); *H05B 37/029* (2013.01); (Continued)

(58) Field of Classification Search
CPC ..... H05B 33/08; H05B 33/0869 (Continued)

(56) References Cited

U.S. PATENT DOCUMENTS 4,523,128 A 6/1985 Stamm et al.
4,691,341 A 9/1987 Knoble et al.
(Continued)

FOREIGN PATENT DOCUMENTS

WO WO 02/079890 A1 10/2002
WO WO 03/034570 A2 4/2003

*Primary Examiner* — Jason Crawford
(74) *Attorney, Agent, or Firm* — Michael Best & Friedrich, LLP

(57) ABSTRACT

A control system including a plurality of high voltage devices grouped into a plurality of zones including a first zone and a second zone, a plurality of low voltage devices, wherein a first low voltage device is associated with the first zone and a second low voltage device is associated with the second zone, and a central control module. The central control module includes a first low voltage connection for receiving at least one first control signal from at least one of the low voltage devices and a high voltage connection for providing at least one second control signal to at least one of the high voltage devices. The central control module is configured to determine a daylight conversion factor based on the at least one control signal. Wherein the at least one second control signal is based at least in part on the daylight conversion factor.

18 Claims, 38 Drawing Sheets

Related U.S. Application Data continuation of application No. 13/886,675, filed on May 3, 2013, now Pat. No. 9,055,624, which is a continuation of application No. 12/662,812, filed on May 4, 2010, now Pat. No. 8,436,542.

(60) Provisional application No. 61/175,343, filed on May 4, 2009.

(52) U.S. Cl.
CPC ..... *H05B 37/0218* (2013.01); *H05B 37/0227* (2013.01); *H05B 37/0245* (2013.01)

(58) Field of Classification Search
USPC ..... 315/152, 297, 312, 294, 307, 291, 316
See application file for complete search history.

(56) References Cited

U.S. PATENT DOCUMENTS 4,924,151 A 5/1990 D'Aleo et al.
4,937,718 A 6/1990 Murray
5,289,365 A 2/1994 Caldwell et al.
5,357,170 A 10/1994 Luchaco et al.
5,402,040 A 3/1995 Sprout
5,406,173 A 4/1995 Mix et al.
5,438,239 A 8/1995 Nilssen
5,446,342 A 8/1995 Nilssen
5,455,487 A 10/1995 Mix et al.
5,471,119 A 11/1995 Ranganath et al.
5,623,186 A 4/1997 Archdekin
5,637,964 A 6/1997 Hakkarainen et al.
5,742,131 A 4/1998 Sprout et al.
5,747,798 A 5/1998 Smith
5,949,200 A 9/1999 Ference et al.
5,962,989 A 10/1999 Baker
5,977,717 A 11/1999 Dean
6,028,396 A 2/2000 Morrissey, Jr. et al.
6,028,522 A 2/2000 Petite
6,046,550 A 4/2000 Ference et al.
6,107,755 A 8/2000 Katyl et al.
6,122,603 A 9/2000 Budike, Jr.
6,181,086 B1 1/2001 Katyl et al.
6,188,177 B1 2/2001 Adamson et al.
6,218,788 B1 4/2001 Chen et al.
6,218,953 B1 4/2001 Petite
6,222,322 B1 4/2001 Stack
6,252,358 B1 6/2001 Xydis et al.
6,300,727 B1 10/2001 Bryde et al.
6,311,105 B1 10/2001 Budike, Jr.
6,339,298 B1 1/2002 Chen
6,340,864 B1 1/2002 Wacyk
6,388,396 B1 5/2002 Katyl et al.
6,388,399 B1 5/2002 Eckel et al.
6,430,628 B1 8/2002 Connor
6,437,692 B1 8/2002 Petite et al.
6,538,568 B2 3/2003 Conley, III
6,555,966 B2 4/2003 Pitigoi-Aron
6,583,573 B2 6/2003 Bierman
6,636,005 B2 10/2003 Wacyk et al.
6,686,705 B2 2/2004 Nerone et al.
6,707,263 B1 3/2004 Prasad
6,731,080 B2 5/2004 Flory
6,813,525 B2 11/2004 Reid et al.
6,841,944 B2 1/2005 Morrissey et al.
6,864,642 B2 3/2005 Nemirow et al.
6,888,323 B1 5/2005 Null et al.
6,891,838 B1 5/2005 Petite et al.
6,904,385 B1 6/2005 Budike, Jr.
6,914,893 B2 7/2005 Petite
6,927,547 B2 8/2005 Walko, Jr. et al.
6,970,751 B2 11/2005 Gonzales et al.
6,979,955 B2 12/2005 Roach et al.
6,990,394 B2 1/2006 Pasternak
7,067,992 B2 6/2006 Leong et al.
7,081,715 B1 7/2006 Goldstein
7,084,574 B2 8/2006 Roach et al.
7,103,511 B2 9/2006 Petite
7,120,560 B2 10/2006 Williams et al.
7,122,976 B1 10/2006 Null et al.
7,126,291 B2 10/2006 Kruse et al.
7,167,777 B2 1/2007 Budike, Jr.
7,190,126 B1 3/2007 Paton
7,211,968 B2 5/2007 Adamson et al.
7,215,088 B1 5/2007 Clark et al.
7,221,110 B2 5/2007 Sears et al.
7,222,111 B1 5/2007 Budike, Jr.
7,307,542 B1 12/2007 Chandler et al.
7,333,903 B2 2/2008 Walters et al.
7,346,433 B2 3/2008 Budike, Jr.
7,369,060 B2 5/2008 Veskovic
7,391,297 B2 6/2008 Cash et al.
7,405,524 B2 7/2008 Null et al.
7,436,132 B1 10/2008 Null
7,446,671 B2 11/2008 Giannopoulos et al.
7,468,661 B2 12/2008 Petite et al.
7,507,001 B2 3/2009 Kit
7,514,884 B2 4/2009 Potucek et al.
7,529,594 B2 5/2009 Walters et al.
7,546,167 B2 6/2009 Walters et al.
7,546,168 B2 6/2009 Walters et al.
7,585,087 B2 9/2009 Gagne et al.
7,603,184 B2 10/2009 Walters et al.
7,619,539 B2 11/2009 Veskovic et al.
7,623,042 B2 11/2009 Huizenga
7,626,339 B2 12/2009 Paton
7,637,628 B2 12/2009 Budike
7,671,544 B2 3/2010 Clark et al.
7,697,492 B2 4/2010 Petite
7,734,356 B2 6/2010 Cleland et al.
7,741,732 B2 6/2010 Black et al.
7,741,782 B2 6/2010 Vermeulen et al.
7,744,254 B2 6/2010 Spiro
7,756,556 B2 7/2010 Patel et al.
7,761,260 B2 7/2010 Walters et al.
7,764,162 B2 7/2010 Cash et al.
7,788,189 B2 8/2010 Budike, Jr.
7,791,492 B2 9/2010 Nam et al.
7,812,543 B2 10/2010 Budike, Jr.
7,834,555 B2 11/2010 Cleland et al.
7,870,080 B2 1/2011 Budike, Jr.
7,880,638 B2 2/2011 Veskovic et al.
7,911,359 B2 3/2011 Walters et al.
7,944,365 B2 5/2011 Walters et al.
7,978,059 B2 7/2011 Petite et al.
8,010,319 B2 8/2011 Walters et al.
8,138,435 B2 3/2012 Patel et al.
8,140,276 B2 3/2012 Walters et al.
8,148,854 B2 4/2012 Shah et al.
8,160,752 B2 4/2012 Weaver
8,214,061 B2 7/2012 Westrick, Jr. et al.
8,227,731 B2 7/2012 Hick et al.
8,232,909 B2 7/2012 Kroeger et al.
8,271,937 B2 9/2012 Anand et al.
8,295,295 B2 10/2012 Winter et al.
8,296,488 B2 10/2012 Westrick, Jr. et al.
8,310,159 B2 11/2012 Bigge et al.
8,312,347 B2 11/2012 Hick et al.
8,340,834 B1 12/2012 Walma et al.
8,346,403 B2 1/2013 Goyal et al.
8,386,661 B2 2/2013 Ostrovsky et al.
8,410,922 B2 4/2013 Null et al.
8,436,542 B2 5/2013 Middleton-White
9,055,624 B2 6/2015 Middleton-White
9,877,373 B2 * 1/2018 Middleton-White ..... H05B 37/0245
2002/0080027 A1 6/2002 Conley, III
2003/0062841 A1 4/2003 Norling
2003/0090210 A1 5/2003 Bierman
2003/0090889 A1 5/2003 Wacyk et al.
2003/0209999 A1 11/2003 Hui et al.
2004/0061454 A1 4/2004 Prasad
2004/0122930 A1 6/2004 Pasternak
2004/0124786 A1 7/2004 Morrissey, Jr. et al.

(56) References Cited

U.S. PATENT DOCUMENTS

2004/0232851 A1 11/2004 Roach, Jr. et al.
2005/0110416 A1* 5/2005 Veskovic ..... E06B 9/32 315/149
2005/0179404 A1 8/2005 Veskovic et al.
2005/0232289 A1 10/2005 Walko, Jr. et al.
2005/0248300 A1 11/2005 Walko, Jr. et al.
2006/0044152 A1 3/2006 Wang
2006/0076908 A1* 4/2006 Morgan ..... H05B 33/0842 315/312
2006/0155423 A1 7/2006 Budike, Jr.
2006/0202851 A1 9/2006 Cash et al.
2006/0215345 A1 9/2006 Huizenga
2007/0013475 A1 1/2007 Hardwick
2007/0145826 A1* 6/2007 Clark ..... H05B 37/0254 307/11
2007/0164681 A1 7/2007 Gagne et al.
2007/0183133 A1 8/2007 Buiji et al.
2007/0189000 A1* 8/2007 Papamichael ..... H05B 39/042 362/1
2007/0228999 A1 10/2007 Kit
2007/0239477 A1 10/2007 Budike, Jr.
2007/0273307 A1 11/2007 Westrick
2007/0273539 A1 11/2007 Gananathan
2007/0285921 A1 12/2007 Zulim et al.
2008/0058964 A1 3/2008 Nickerson et al.
2008/0061668 A1 3/2008 Spiro
2008/0067959 A1 3/2008 Black et al.
2008/0074059 A1 3/2008 Ahmed
2008/0084270 A1 4/2008 Cash
2008/0097782 A1 4/2008 Budike, Jr.
2008/0111498 A1 5/2008 Budike
2008/0185977 A1 8/2008 Veskovic et al.
2008/0197790 A1 8/2008 Mangiaracina et al.
2008/0317475 A1 12/2008 Pederson et al.
2009/0001893 A1 1/2009 Cleland et al.
2009/0066258 A1 3/2009 Cleland et al.
2009/0085500 A1 4/2009 Zampini, II
2009/0278472 A1 11/2009 Mills et al.
2009/0278479 A1 11/2009 Platner
2009/0302782 A1 12/2009 Smith
2009/0315485 A1 12/2009 Verfuerth et al.
2009/0322232 A1 12/2009 Lin
2009/0322250 A1 12/2009 Zulim et al.
2010/0001652 A1 1/2010 Damsleth
2010/0007289 A1 1/2010 Budike, Jr.
2010/0029268 A1 2/2010 Myer et al.
2010/0067227 A1 3/2010 Budike
2010/0176733 A1 7/2010 King
2010/0188025 A1 7/2010 Adenau
2010/0274945 A1 10/2010 Westrick, Jr. et al.
2010/0280677 A1 11/2010 Budike, Jr.
2011/0134649 A1 6/2011 Becker et al.
2011/0180687 A1 7/2011 Rains, Jr. et al.
2011/0116046 A1 8/2011 Haas et al.
2011/0288658 A1 11/2011 Walters et al.
2012/0147705 A1 6/2012 Hick
2012/0153840 A1 6/2012 Dahlen et al.
2012/0189298 A1 7/2012 Ohad et al.
2012/0313588 A1 12/2012 Carberry et al.

* cited by examiner

TO FIG. 9(a)-2

DIMMING CONTROL

| CURRENT DAYLIGHT | DAYLIGHT AT TASK | ARTIFICAL LIGHT LEVEL | DAYLIGHT CONVERSION | DIMMED LEVEL |
|---|---|---|---|---|
| 500fc | 15fc | 50fc | 33.3=1fc | 7.0 VDC - 70% |
| 750fc | 22.5fc | 50fc | 33.3=1fc | 5.5 VDC - 55% |
| 1000fc | 30fc | 50fc | 33.3=1fc | 4.0 VDC - 40% |
| 1250fc | 37.5fc | 50fc | 33.3=1fc | 2.5 VDC - 25% |
| 1500fc | 45fc | 50fc | 33.3=1fc | 1.0 VDC - 10% |
| 1750fc | 52.5fc | 50fc | 33.3=1fc | 0.0 VDC - 0% |
| 2000fc | 60fc | 50fc | 33.3=1fc | 0.0 VDC - 0% |

FIG. 12

| CURRENT DAYLIGHT | DAYLIGHT AT TASK | ARTIFICAL LIGHT LEVEL | DAYLIGHT CONVERSION | DIMMED LEVEL |
|---|---|---|---|---|
| 500fc | 15fc | 50fc | 33.3=1fc | ROW#1 ON |
| 750fc | 22.5fc | 50fc | 33.3=1fc | ROW#1 ON |
| 1000fc | 30fc | 50fc | 33.3=1fc | ROW#1 ON |
| 1250fc | 37.5fc | 50fc | 33.3=1fc | ROW#1 ON |
| 1500fc | 45fc | 50fc | 33.3=1fc | ROW#1 ON |
| 1750fc | 52.5fc | 50fc | 33.3=1fc | ROW#1 OFF |
| 2000fc | 60fc | 50fc | 33.3=1fc | ROW#1 OFF |

FIG. 13

INTEGRATED LIGHTING SYSTEM AND METHOD

CROSS-REFERENCE TO RELATED APPLICATION

This application is a continuation of U.S. patent application Ser. No. 14/715,315 filed on May 18, 2015, which is a continuation of U.S. patent application Ser. No. 13/886,675 filed on May 3, 2013, which is a continuation of U.S. patent application Ser. No. 12/662,812 filed on May 4, 2010, issued May 7, 2013 as U.S. Pat. No. 8,432,542, which claims benefit under 35 U.S.C. § 119(e) from provisional patent application Ser. No. 61/175,343 filed on May 4, 2009, the entire disclosures of which are hereby incorporated by reference.

BACKGROUND OF THE INVENTION

1. Field of the Invention

The present invention generally relates to systems and methods for controlling area lighting. More particularly, the present invention relates to lighting systems and methods for controlling indoor lighting by providing flexible and programmable control based on occupancy and daylight contribution.

2. Discussion of the Background

Indoor facilities such as classrooms require robust, capable and flexible lighting and control solutions that serve the user and save energy. Static lighting systems designed to IES specifications service only a small portion of the actual lighting requirements that exist in today's classroom environment Complicating the design of these solutions are energy codes, which are becoming more and more restrictive on schools: ASHRAE Standard 90.1-1999/2001 prescribes a maximum power density of 1.6 W/sq. ft for classrooms. ASHRAE 90.1-2004/2007 goes further with a prescribed 1.4 W/sq. ft and California's Title 24-2005 takes it even further with a requirement for a maximum density of 1.2 W/sq. ft.

To service the needs of the educator and to support the educational environment, classroom lighting and control solutions must be flexible and capable of providing multiple lighting scenarios "visual environments" that support or enhance the varied educational tools which may be utilized such as whiteboard, video and multimedia presentations. The modern classroom requires a range of lighting scenarios, from full lighting for traditional teaching to various levels of dimming and light distribution for audiovisual (A/V) presentations and other activities. Most existing systems don't have the flexibility to provide high-quality lighting in this varying environment. Typical classroom lighting solutions do not meet the functional needs of teachers or students.

Classroom lighting and control solutions must be energy efficient. Occupancy Sensing, Daylight Harvesting and Demand Response energy saving strategies can all be deployed in these spaces to significantly reduce energy costs and meet codes and regulations. Most importantly, a successful classroom lighting and control solution must be cost effective, simple to install and commission, easy to understand and simple to use.

SUMMARY OF THE INVENTION

Exemplary embodiments of the present invention address at least the above problems and/or disadvantages and provide at least the advantages described below.

Exemplary embodiments of the present invention provide a system and method where a plurality of luminaires, control switches, occupancy detectors, and photocells are connected to a central control module.

Exemplary implementations of certain embodiments of the present invention provide a display and keypad user interface which is used for setting up, testing, commissioning and maintaining the system; a memory card interface and associated memory card which can be used to load and save configuration data, update firmware, and log system operation.

Another exemplary embodiment of the invention provides a system and method where a lighting system can be set up and tested and then the configuration saved in a portable memory, such as on a memory card. For example, a memory card can be transferred to another system where it is read to facilitate faster and easier configuring of the other system to parallel, or to be exactly like, the original system.

According to yet another exemplary embodiment of the invention, a system and method provide for automatic recognition of the type of data stored on a portable memory (such as a memory card) to perform appropriate actions such as, for example: update configuration, or update firmware.

According to yet another exemplary embodiment of the invention, a system and method provide for switching between different mutually exclusive lighting modes where the lighting of each mode is sequenced such that the second lighting mode is initiated before the first mode is terminated, resulting in a continuity of lighting in the controlled area.

According to yet another exemplary embodiment of the invention, a system and method provide for daylight harvesting control with multiple zone dimming and switching, programmable attack and decay dimming rates, the ability to return a system to its previous dimming level after the lights have been turned off, and the ability to start the controlled lights at full light level then dim down to the previous level to ensure the lighting ballasts have sufficient voltage to start up.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

9(*h*)-1, 9(*h*)-2, 9(*i*)-1, 9(*i*)-2, 9(*j*), and 10(*a*)-10(*b*) provide detailed circuit diagrams illustrating exemplary implementations of the various components of systems according to exemplary embodiments of the present invention.

Figure 11:
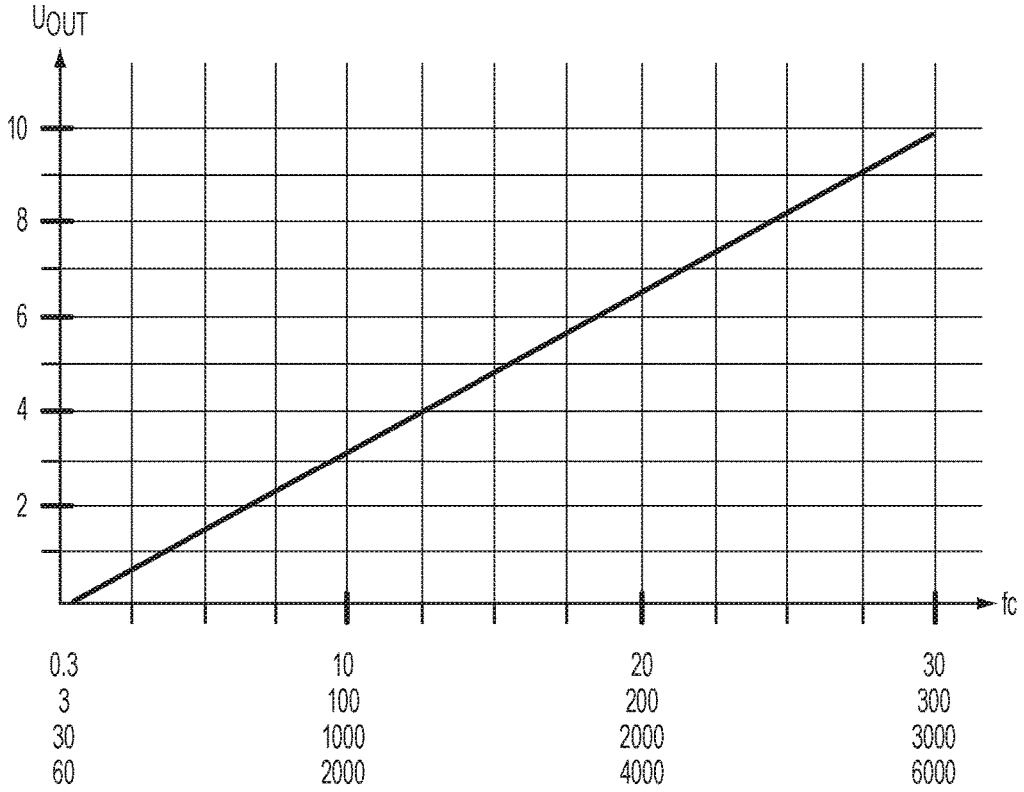

FIG. 11 provides a graphical illustration of an output of a photo sensor according to an exemplary embodiment of the present invention.

FIGS. 12 and 13 provide tabular illustrations of calculation for controlling lighting based on photo sensor output according to exemplary embodiments of the present invention.

DETAILED DESCRIPTION OF EXEMPLARY EMBODIMENTS

Referring now to the drawings, wherein like reference numerals designate identical or corresponding parts throughout the several views, embodiments of the present invention are shown in schematic detail.

The matters defined in the description such as a detailed construction and elements are nothing but the ones provided to assist in a comprehensive understanding of the invention. Accordingly, those of ordinary skill in the art will recognize that various changes and modifications of the embodiments described herein can be made without departing from the scope and spirit of the invention. Also, well-known functions or constructions are omitted for clarity and conciseness. Exemplary embodiments of the present invention are described below in the context of a classroom application. Such exemplary implementations are not intended to limit the scope of the present invention, which is defined in the appended claims.

Figure 1:
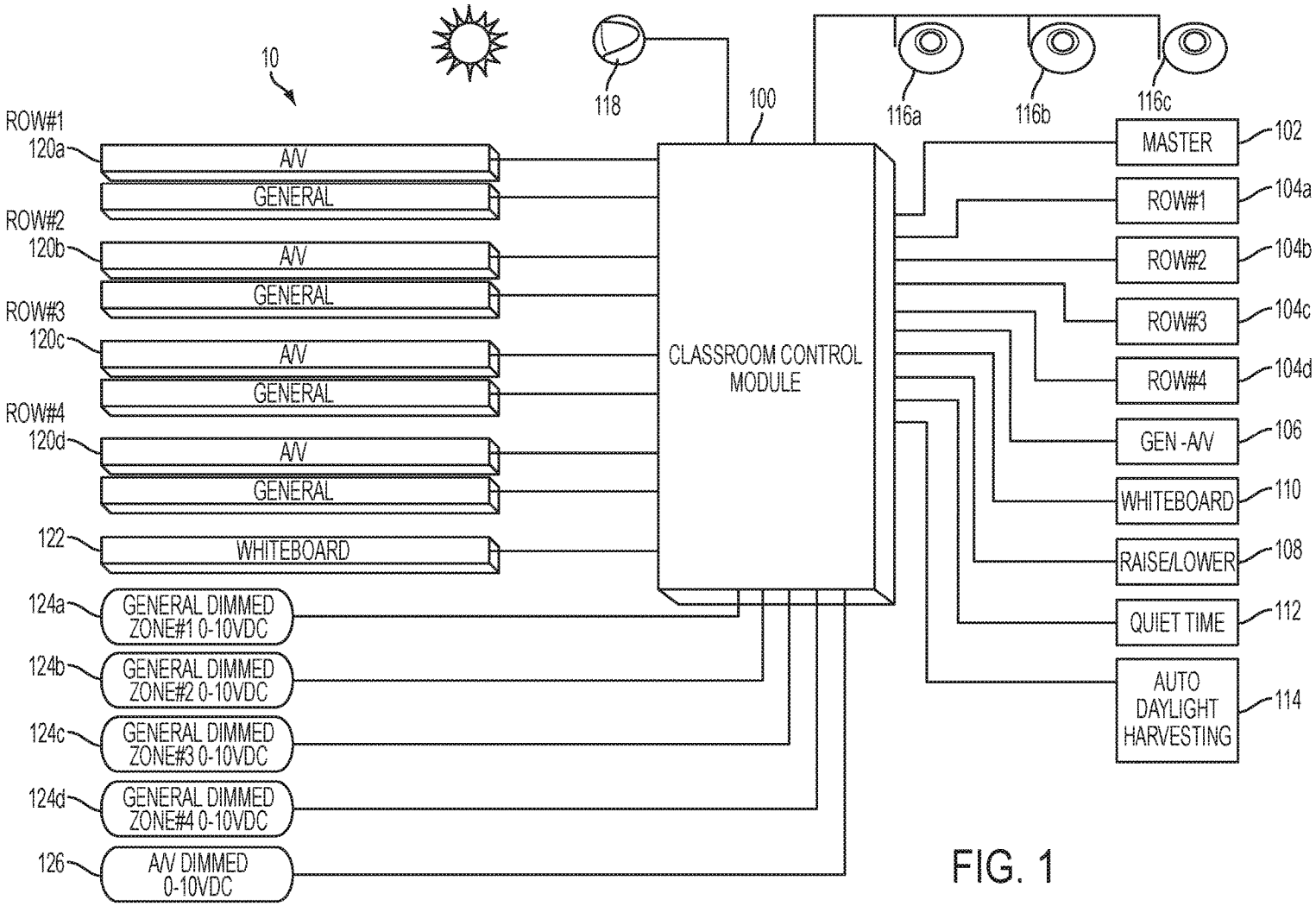
FIG. 1 provides a block diagram of a system according to an exemplary embodiment of the present invention.

According to exemplary embodiment of the present invention, a system and method are provided where a classroom lighting control solution includes the following components, as illustrated in the example of FIG. 1:

Classroom Control Module 100

Master ON/OFF Switch Station 102

Row ON/OFF Switch Stations (Rows 1-4) 104*a*, 104*b*, 104*c* and 104*d*, respectively Gen-A/V Switch Station 106

AV Raise/Lower Switch Station 108

Whiteboard ON/OFF Switch Station 110

Quiet Time Switch Station 112

Auto (Daylight Harvesting) Switch Station 114

Occupancy Sensors (one or more) 116*a*, 116*b*, 116*c*

Indoor Photo Sensor 118

Classroom Control Module 100:

In an exemplary implementation, a classroom control module 100 contains all of the switching and dimming components necessary for the control of an entire classroom lighting system 10. The classroom control module can be designed to control up to four individual rows of recessed or pendant mounted lighting fixtures 120*a*, 120*b*, 120*c*, 120*d* (with alternate switching of A/V and General lighting modes and individual row control) and one Whiteboard lighting circuit 122 with ON/OFF control.

The classroom control module can be provided with the following:

Control of 1 to 4 Rows of recessed or pendant mounted fixtures 120*a*, 120*b*, 120*c*, 120*d* each with General and A/V lighting circuits Control of 1 Whiteboard 122 circuit ON/OFF 1-0-10 VDC Dimming output A/V 126

4-0-10 VDC Dimming output GEN daylight harvesting 124*a*, 124,*b*, 124*c*, 124*d* (1-output may be sufficient. 4-outputs would allow more flexible functionality)

ON/OFF daylight harvesting via row switching with selectable row control (rows 1-4)

In an exemplary implementation, the classroom control module 100 can be provided with a user interface 200 including, for example, a display 202 (such as a 2 line by 16-character display) with, for example push buttons 204*a*, 204*b* for screen navigation, and buttons 206*a* and 206*b* for selection of menu items. Other user interfaces, such as touch screens to facilitate ease of operation, can be implemented and are within the scope of the present invention.

The classroom control module 100 can also include an interface for connection to other lighting control systems to provide for programming and scheduling accordingly.

In an exemplary implementation, the classroom control module 100 can be provided with a maintained dry contact input to cause the classroom control module to go to a demand response mode. In the demand response mode, the classroom control module 100 limits the output of general and AV lighting modes to the demand response level as set at the classroom control module 100. Demand response levels can be set by means of the user interface 200 of the classroom control modules 100, as later described in further detail in the context of certain exemplary implementations.

General-A/V Switching Control

A classroom control module 100 can be designed to allow classroom lighting to be in either the General or A/V modes and ensure that both modes may never be ON at the same time. Selection of current mode can be provided by means of momentary low voltage inputs.

Row Switching Control

A classroom control module 100 can allow for individual or master ON/OFF control of 1 to 4 rows of General-A/V lighting. Control can be provided by means of momentary low voltage inputs.

Raise/Lower Control

A classroom control module 100 can provide a 0-10 VDC output for A/V dimming control. Control can be provided by means of momentary low voltage inputs.

Whiteboard ON/OFF Control

A classroom control module 100 can provide for ON/OFF control of a single whiteboard 122 circuit. Control can be provided by means of momentary low voltage inputs.

Quiet Time

A classroom control module 100 can provide for a quiet time override. The quiet time override can inhibit the occupancy OFF command for a period of 60 minutes. At the end of the quiet time duration the control module can return control to the occupancy sensor and turn lighting OFF if no occupancy is present in the classroom.

Occupancy Sensor Control

A classroom control module 100 can allow for the connection of one or more occupancy sensor(s), for example 3 occupancy sensors 116*a*, 116*b*, 116*c*. The control module 100 can provide power and receive inputs from the occupancy sensors 116*a*, 116*b*, 116*c* in order to determine the current state of occupancy of the classroom—either occupied or unoccupied. Upon a change from unoccupied to occupied states the classroom control module 100 can switch the classroom lighting to the general mode, turn all rows ON and engage automatic daylight harvesting if present. Upon a change from occupied to unoccupied states, the classroom control module 100 can switch all lighting OFF General Lighting Continuous Dimming Daylight Harvesting Control A classroom control module 100 can receive current daylight level information from an indoor photo sensor 118. According to an exemplary implementation, a function of a daylight harvesting sensor, such as indoor photo sensor 118, is to monitor incoming daylight, calculate the appropriate levels that the general artificial lighting may be dimmed to save energy while maintaining desires foot-candle levels at task and send a 0 to 10 VDC signal to the general lighting to dim it to the appropriate level. To accomplish this a classroom control module can be implemented to receive and process information and operate as follows:

A. Current incoming Daylight Level: This information can be received from an indoor photo sensor 118 as a linear signal from 0 to 10 VDC in 4 possible ranges 0.3 to 30 fc, 3 to 300 fc, 30 to 3000 fc and 60 to 6000 fc as shown in the graph of FIG. 11. Software can be designed to have the sensor set to the 30 to 3000 fc range.

B. Current Daylight Contribution: (Daylight read at task): Current daylight contribution readings for zones 1-4 as read at task during the mid portion of the day with the artificial lighting turned off. Daylight readings taken can be entered into a classroom control module 100 by means of a user interface 200. Daylight lighting levels should be entered for each daylight harvesting zone being controlled. If a daylight harvesting zone will not be used there is no need to enter a level for it.

C. Designed or Measured Artificial Lighting Level (Designed levels or actual artificial lighting levels as read at task): Artificial lighting design or measured levels for zones 1-4 can be entered into the classroom control module 100 by means of the user interface 200. As in the case of daylight, artificial lighting levels should to be entered for each daylight harvesting zone being controlled. If a daylight harvesting zone will not be used there is no need to enter a level for it.

D. Operation: In order to set the classroom control module's daylight harvesting settings a user can perform the following steps.

1. Turn off the artificial lighting.
2. Take readings during the mid portion of the day of the actual daylight fc level at task with a light meter.
3. Input the measured daylight fc level into classroom control module 100 via user interface 200.
4. Input design fc level into the classroom control module 100 via user interface 200. This may be accomplished by inputting designed levels or by taking measurements of actual artificial lighting levels with no daylight present.

Once the above steps are completed, the classroom control module 100 can calculate the daylight conversion factor and begin outputting the appropriate dimmed level (0 to 10 VDC) to the general lighting. An example of such calculations is illustrated in a table of FIG. 12.

E. Dimming Response (Fade Up and Fade Down Rate): The controller 100 can be designed to respond quickly to decreases in natural daylight and more slowly to increases in natural daylight. The exact rate of these changes can be adjusted during testing, once determined these values can be entered into the controller 100 as default values. These values can also be adjustable by via user interface 200.

F. Response Delay: In order to keep sudden temporary changes in daylight from causing output the sensor 118 to needlessly change the dimmed level of its controlled fixtures, the sensor 118 can have built-in delays to numb the effects of sudden changes in daylight. For example, sensor 118 can have two built-in delays: one for reacting to decrease in daylight and one for reacting to an increase in daylight. The default delay for reacting to increases in daylight can be set to, for example, 10 seconds and the default delay for reacting to decreases in daylight can be set to, for example, 2 seconds. These values can also be adjustable via the user interface 200

General Lighting Switched Row Daylight Harvesting Control

According to another exemplary implementation, a function of the daylight harvesting sensor 118 is to monitor incoming daylight, calculate the appropriate levels at which individual rows of the general artificial lighting may be switched OFF to save energy while maintaining desires foot-candle levels at task. To accomplish this, a classroom control module 100 can be implemented to receive and process information and operate as described above in the context of General Lighting Continuous Dimming Daylight Harvesting Control Section, Parts A through F. However, in this exemplary implementation operation step 4 of Part D is replaced by the following step:

4. Input design fc level into the Classroom Control Module. This may be accomplished by inputting designed levels or by taking measurements of actual artificial lighting levels with no daylight present.

Once the above steps are completed the Classroom Control Module 100 calculates the daylight conversion factor and begins control of the artificial general lighting by switching ON and OFF rows of artificial lighting as needed. An example of such calculations for a row #1 of artificial lighting is illustrated in a table of FIG. 13.

According to an exemplary implementation of certain embodiments of the present invention, a control module 100 can be generally configured as illustrated in FIGS. 4*a*-4*c*, 5 and 6, where:

1. Enclosure 400 can be metal to allow for simple connection of field conduit or other wiring system to control module 100.
2. Enclosure 400 size can be as small as functionally possible.
3. Enclosure 400 can be NEMA 1 enclosure designed and rated for plenum installation.
4. Enclosure 400 can be finished in a color so as to uniquely identify it from other such enclosures that may be mounted in the classrooms plenum.
5. Enclosure 400 can be designed to easily mount to, for example, plywood backing
6. Removable screw 404 can be used to secure cover 402 of enclosure 400, which may also be hinged and/or configure to lock, and includes openings 406 for wiring.
7. The design can allow the installing contractor adequate access to mount the enclosure 400 and access all required terminals, e.g., 410 and 420 for installation and connection of field wiring.
8. Line voltage electrical connections can be made to appropriately labeled terminal blocks 420 designed to accept standard field wiring.
9. Enclosure 400 can be provided with, for example color coded, RJ45 and RJ11 connectors 410 for the connection of switch stations and low voltage connection to lighting fixtures.
10. Enclosure 400 can have individually labeled RJ45 connectors 410 for each switch station type for simple Plug and Play connection of remote switch stations
11. Enclosure 400 can be provided with, for example 4, RJ11 connectors 410 appropriately labeled for general lighting daylight harvesting
12. Enclosure 400 can be provided with, for example 1, RJ11 connector appropriately labeled for A/V lighting dimming control.

13. Enclosure 400 can be configured to receive 120/347 VAC 50/60 Hz—universal input voltage via access opening 408
14. Line voltage electrical connection can be made to terminal blocks 420 via openings 406 designed for use with 16 to 10 gauge wire
15. Class 2 electrical connection can be made via plug-in connectors 410, such as type RJ45 or RJ11 connectors.

Figure 2:
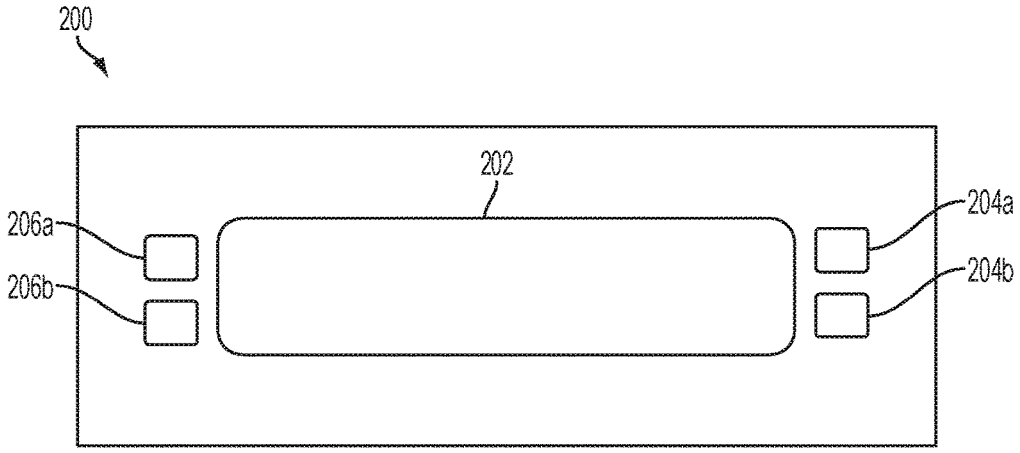
FIG. 2 provides a block diagram of a user interface for a control module according to an exemplary embodiment of the present invention.

As further illustrated in the exemplary implementations of FIGS. 4*a*-4*c* and 5, enclosure 400 includes a low voltage (class 2) section 412 and a high voltage section 414 separated by high voltage/class 2 barrier 416. A transformer 418 provided in section 414 supplies power to low voltage components of section 414. User interface 430, such as a user interface 200 of FIG. 2, including display 432 and controls (e.g., menu navigation keys) 434, is configured in section 412. On the other hand, switching relays 422 and terminal blocks 420 are configured in high voltage section 414.

Figure 6:
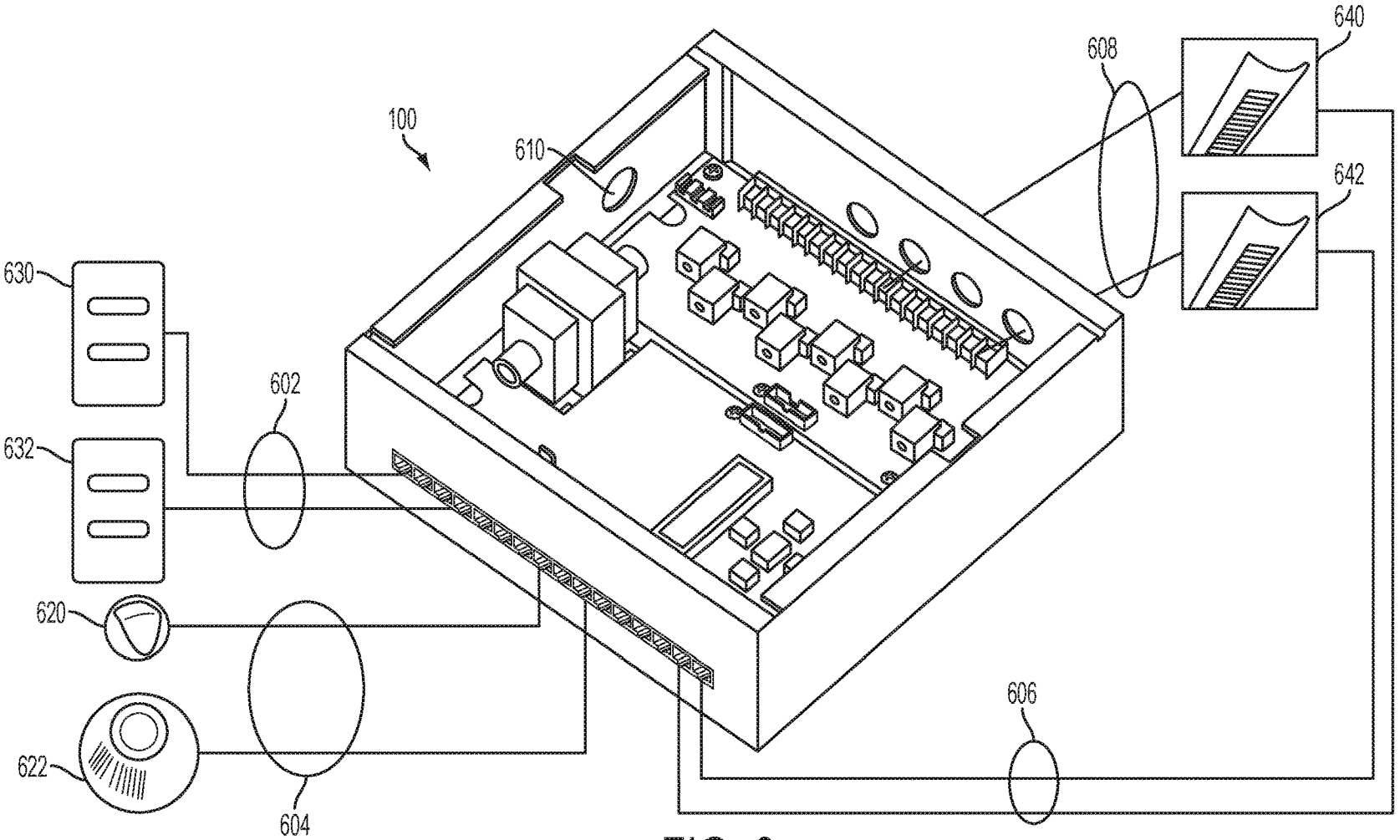
FIG. 6 provides an illustrative drawing of a control module according to an exemplary embodiment of the present invention and exemplary connections of such module to various components of a system according to embodiments of the present invention.

As further illustrated in the exemplary implementations of FIG. 6, a plurality of bus lines, each having a specific function, such as switching 602, detecting 604, or diming control 606, connect to controller 100. Controller 100 receives live voltage input 610 and supplies it to light fixtures via wiring 608 connected to terminal blocks 420.

According to an exemplary embodiment, the nodes being controlled get their intelligence from the system and are coupled to a particular sensor, such as an indoor photo sensor 620 and occupancy sensor 622, or a switch, such as GEN-A/V switch 630 and dimming switch 632; each is attached to proper node and can be color coded to prevent mixing during installation. In the example of dimming control, dimming signals pass through the control module 100 for added intelligence, such as timing of light level, before being sent to light fixtures 640,642 by means of low voltage dimming control 606.

Figure 3:
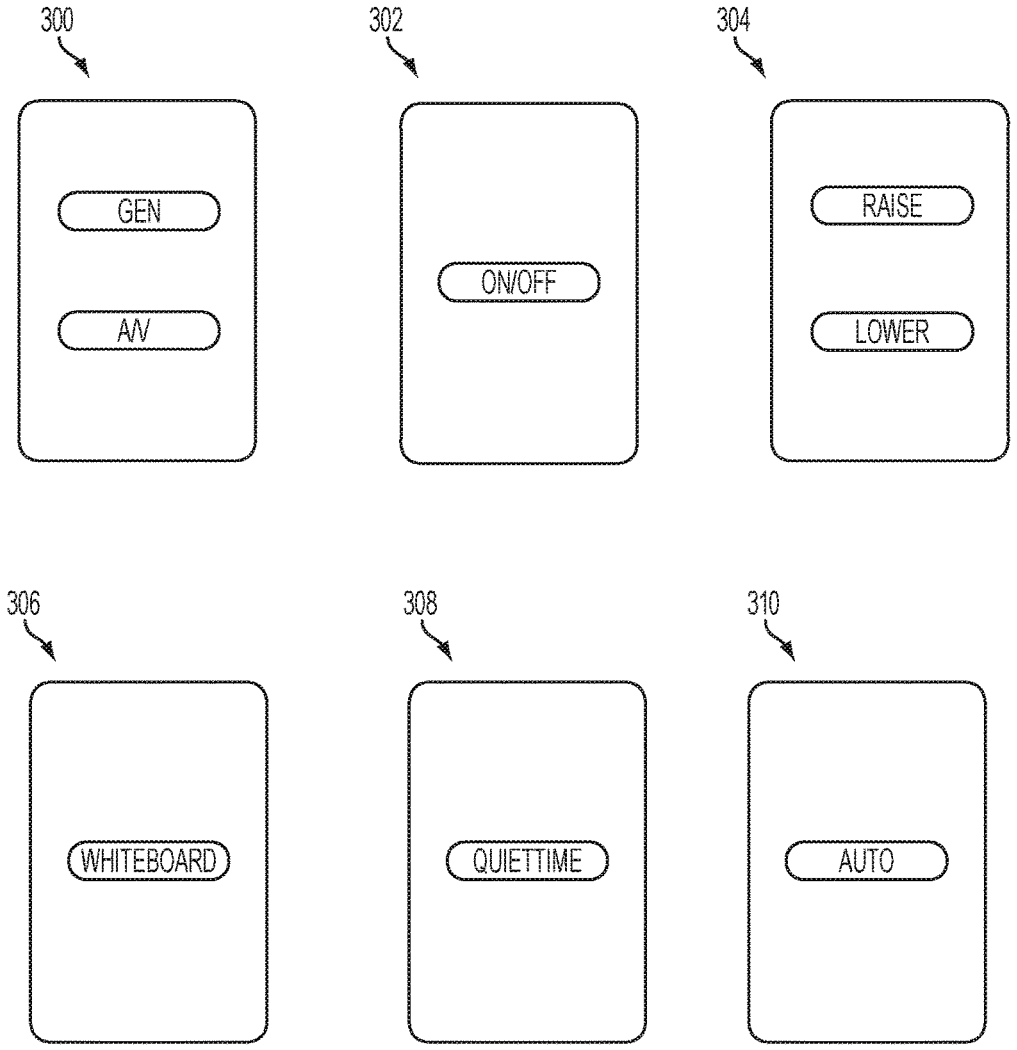
FIG. 3 provides conceptual diagrams of switching stations according to exemplary embodiments of the present invention.
Figure 4A:
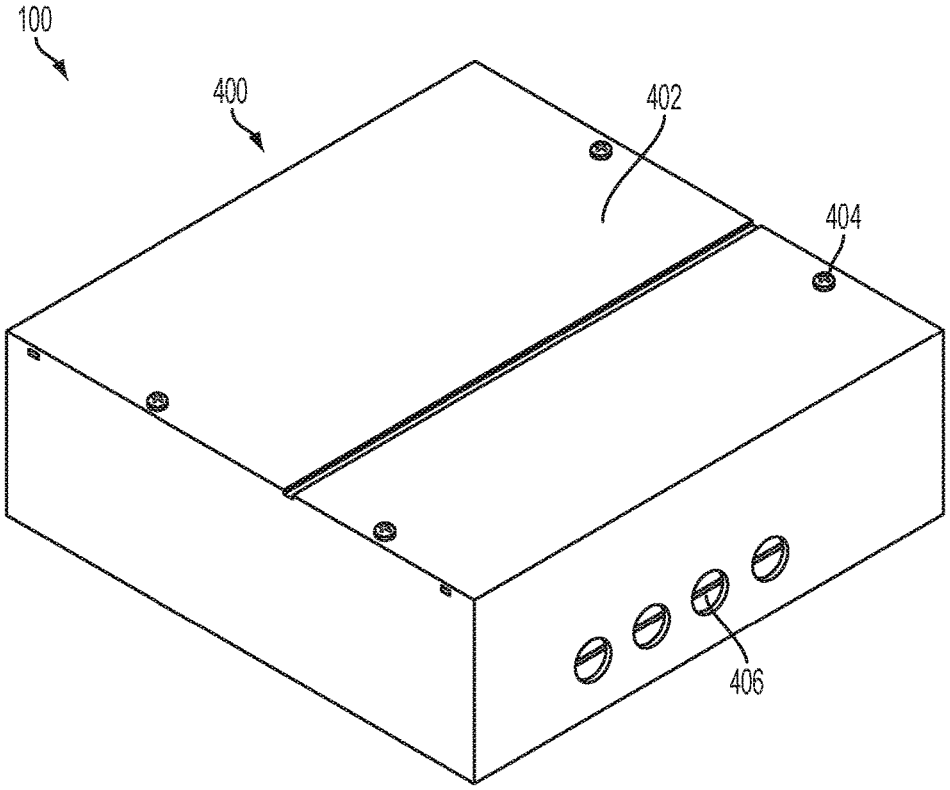
FIGS. 4(*a*)-4(*c*) and 5 provide illustrative drawings of a control module according to exemplary embodiments of the present invention.
Figure 4B:
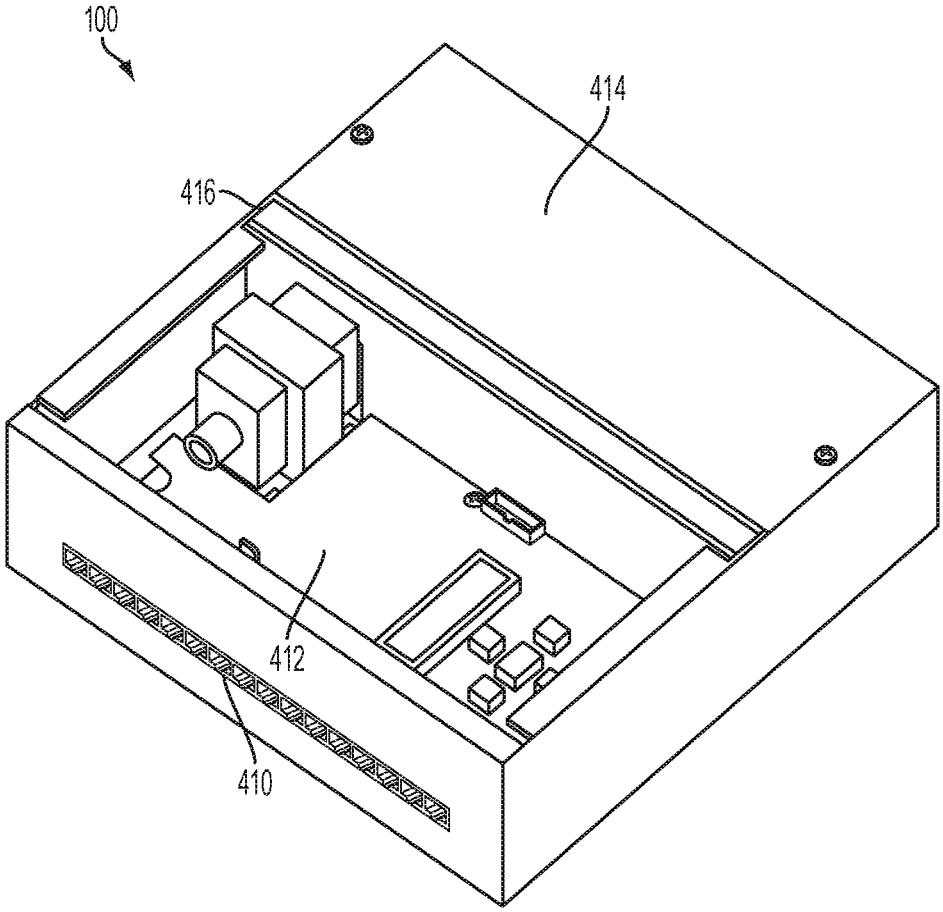
Figure 4C:
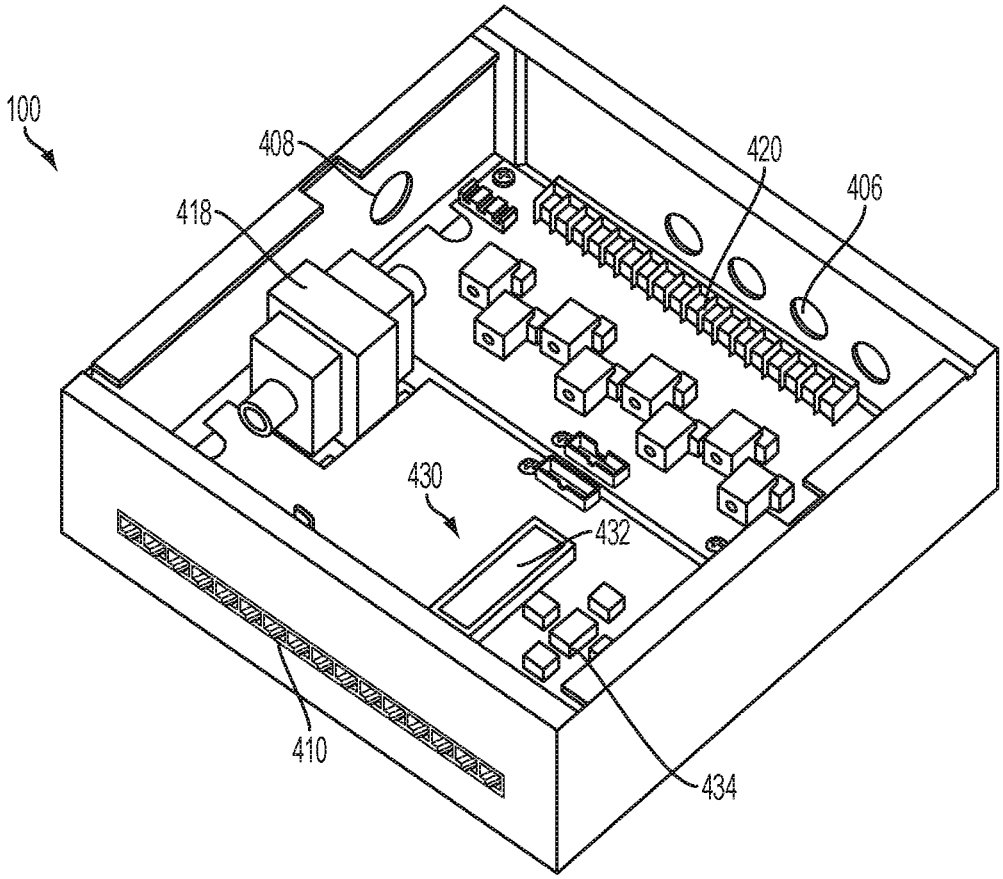
Figure 5:
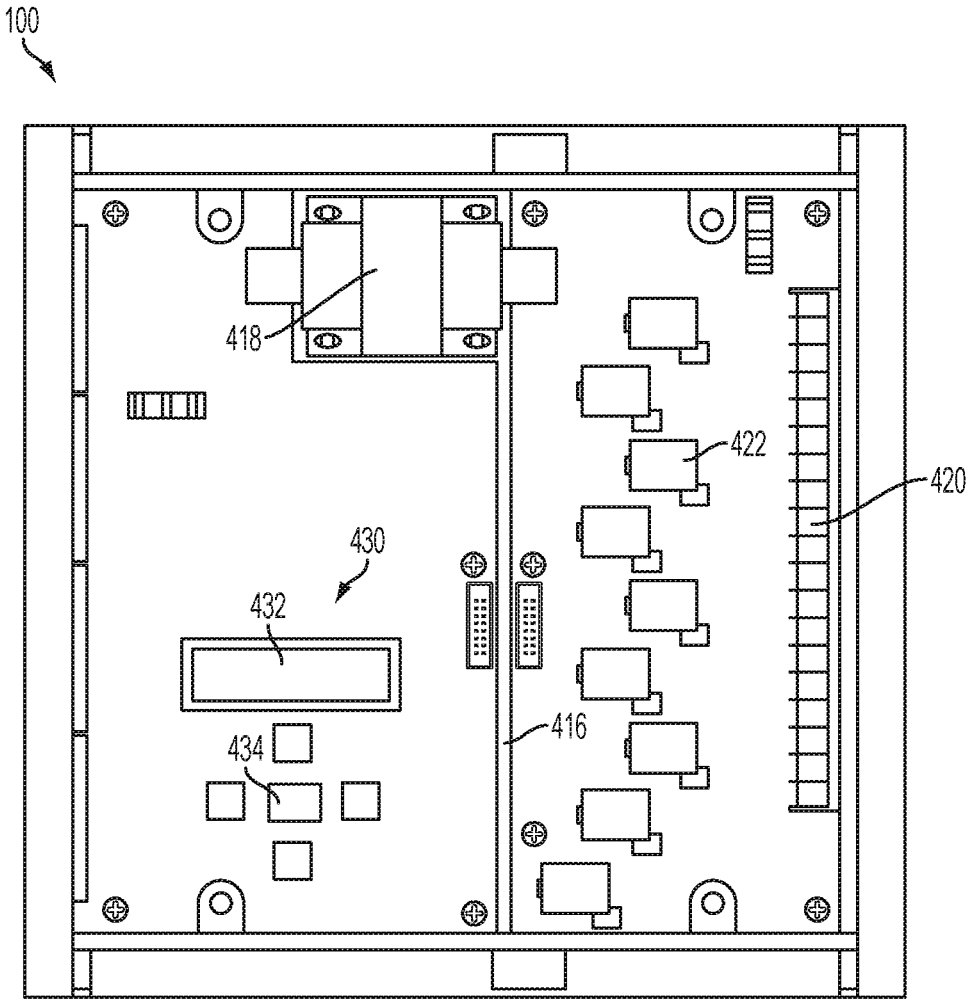

According to exemplary embodiment, low voltage switch stations, such as 102, 104*a-d*, 106, 108, 110, 112 and 114 of FIG. 1, can be implemented as generally illustrated in FIG. 3, where the switching station is, for example, designed to fit into a single gang electrical box and can be used with a standard plate cover, and multiple switch stations may be installed into a single multi gang junction box with a multi gang cover plate. Exemplary operations and functionality provided by such switch stations are as follows:

GEN-A/V Switch Station

GEN-A/V Switch Station allows a user to select between general and A/V lighting modes and can be implemented as a single gang switch station with 2 momentary push buttons GEN and AV 300 connected to controller 100 via, for example, plug-in class 2 electrical connector such as RJ45, where in operation:

1. When the GEN switch is momentarily depressed the controller 100 turns the A/V lighting OFF and turns the General lighting ON.
2. When the A/V switch is momentarily depressed the controller 100 switches the General lighting OFF and turns ON the A/V lighting.
3. Controller 100 can be configured such that at no time the controller 100 allows for both General and A/V lighting to be in the ON state.
4. When A/V dimming is in use, A/V lighting is configured to switch ON and OFF at current dimmed levels. (Last level).
5. When general lighting daylight harvesting is in use general lighting can be configured to switch ON and OFF at levels determined by daylight harvesting.

Master ON/OFF Switch Station

Master ON/OFF switch station allows a user to turn all lighting rows ON and OFF and can be implemented as a single gang switch station 302 with 1 momentary push button ON/OFF connected to controller 100 via, for example, plug-in class 2 electrical connector such as RJ45. During operation, when the ON/OFF switch is momentarily depressed the controller alternately switches all Rows ON and OFF.

Row ON/OFF Switch Station: (Rows 1-4)

Row ON/OFF switch station allows a user to turn all lighting rows ON and OFF and can be implemented as a single gang switch station 302 with 1 momentary push button ON/OFF connected to controller 100 via, for example, plug-in class 2 electrical connector such as RJ45. During operation, when the ON/OFF switch is momentarily depressed the controller alternately switches the controlled Row 1-4 ON and OFF.

Raise/Lower Switch Station

Raise/Lower Switch Station allows the system user to raise and lower A/V lighting levels and can be implemented as a single gang switch station with 2 momentary push buttons Raise and Lower 304 connected to controller 100 via, for example, plug-in class 2 electrical connector such as RJ45, where in operation:

1. When the Raise switch is momentarily depressed the controller raises the current A/V lighting level 1 step.
2. When the Lower switch is momentarily depressed the controller lowers the A/V lighting level 1 step.
3. If the Raise or Lower push button is depressed for more than 1 second the classroom control module 100 raises or lowers the A/V lighting level 1 step every 500 ms until the maximum or minimum level is reached.
4. A/V dimming for 0 to 100% can be provided in 10 even steps.
5. Once the controller has reached it maximum or minimum level, repeated presses of the Raise or Lower push button can be configured to have no effect on A/V lighting levels.

Whiteboard Switch Station

Whiteboard switch station allows a system user to turn ON or OFF the Whiteboard lighting and can be implemented as a single gang switch station 302 with 1 momentary push button Whiteboard 306 connected to controller 100 via, for example, plug-in class 2 electrical connector such as RJ45. During operation, when the Whiteboard switch is momentarily depressed the controller alternately switches the Whiteboard lighting ON and OFF.

Quiet Time Switch Station

Quite Time switch station allows a system user to temporarily override the occupancy sensors OFF command and can be implemented as a single gang switch station 302 with 1 momentary push button Quite Time 308 connected to controller 100 via, for example, plug-in class 2 electrical connector such as RJ45, where in operation:

1. When the Quiet Time switch is momentarily depressed the controller 100 overrides/inhibits the occupancy sensors OFF command for a period of 60 minutes.
2. If the Quiet Time switch is momentarily depressed during the Quiet Time the Quiet Time is reset to 60 minutes.
3. If the Quiet Time switch is pressed and held for a period of 10 seconds the Quiet Time override period is ended and the occupancy sensor OFF inhibit is removed allowing the occupancy sensor to turn lighting OFF when occupancy is no longer detected.

Auto (Daylight Harvesting) Switch Station

Auto switch station allows a system user to command the system go into the general lighting daylight harvesting mode, and can be implemented as a single gang switch station 302 with 1 momentary push button Auto 310 connected to controller 100 via, for example, plug-in class 2 electrical connector such as RJ45. During operation, when the Auto switch is momentarily depressed the controller goes into the General lighting daylight harvesting mode and dims the general lighting as commanded by the controller 100.

A system may include any number of GEN-A/V, ON/OFF, Raise/Lower, Whiteboard, Quite Time, or Auto switch stations.

Figure 7A:
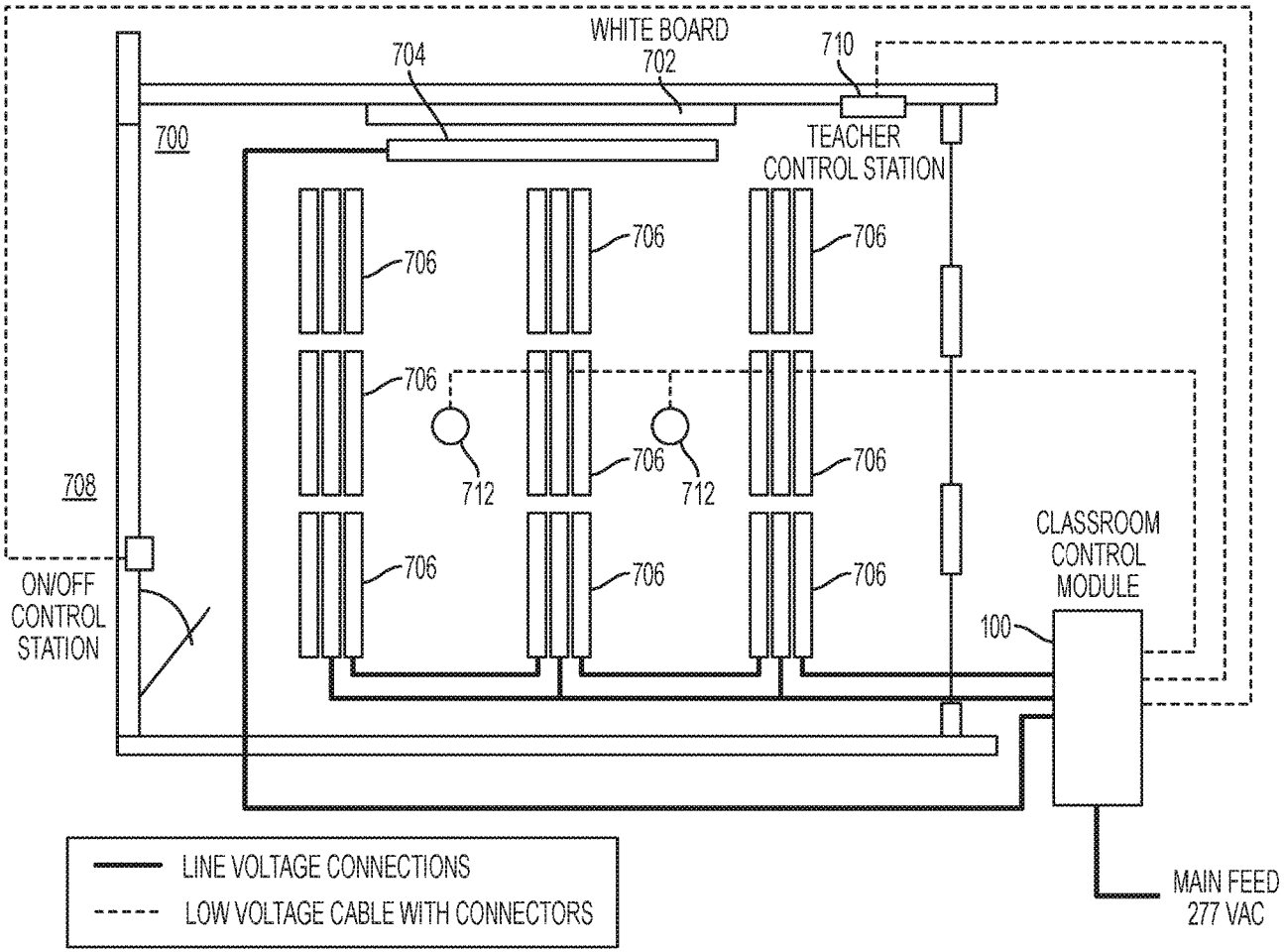
FIGS. 7(*a*)-7(*c*) provide block diagrams of systems according to exemplary embodiments of the present invention.

Exemplary implementations of lighting systems according to embodiments of the present invention are illustrated in FIGS. 7(*a*)-7(*c*). For example, FIG. 7(*a*) illustrates a system deployed in a classroom setting 700, where the system provides ON/OFF control for White Board 702 by controlling light output of fixture 704, as well as control of General and A/V lighting by controlling light output of fixtures 706. For such systems, switch stations may include: an ON/OFF control station 708, which can be disposed near classroom entrance; and/or a teacher control station 710, which can be disposed near the White Board. Commands from stations 708 and 710 are communicated to a control module 100 via low voltage cables, and control module 100 supplies power from a main feed to fixtures 704 and 706, accordingly, via line voltage connections. Occupancy sensors 712 connected to control module 100 via low voltage cables provide additional lighting control, such as automatic light shut off after no occupancy has been detected for a period of time.

Figure 7B:
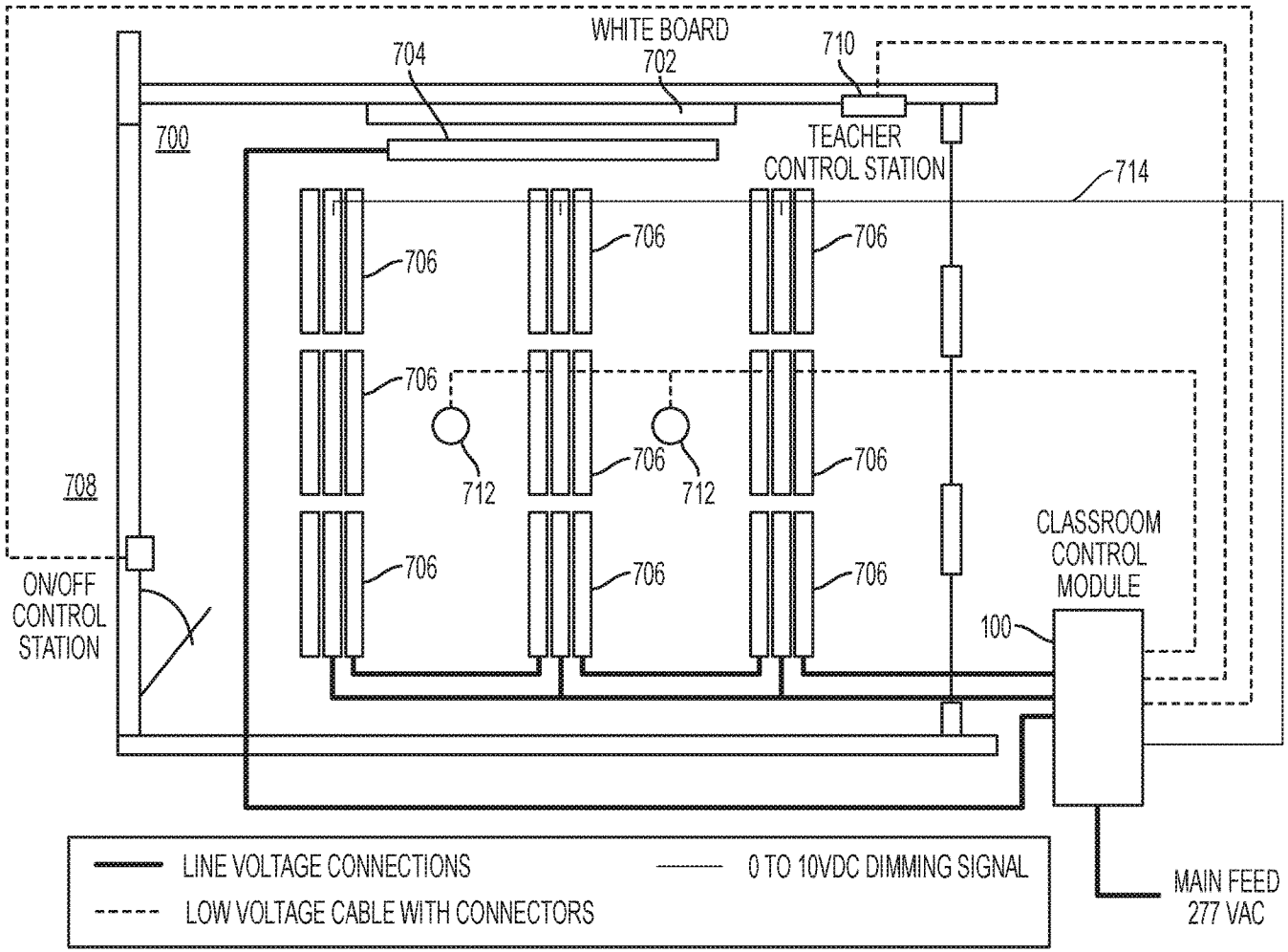

In the example of FIG. 7*b*, the system further provides for dimming control, such that control module 100 provides dimming control to fixtures 706 as a low voltage dimming signal on line 714. For example, teacher station 710 may include a dimming switch which provides dimming control information to module 100, which in turn generates a dimming signal on line 714 accordingly. On the other hand, dimming control may be automatic, based on for example occupancy presence or absence, or a time out period.

Figure 7C:
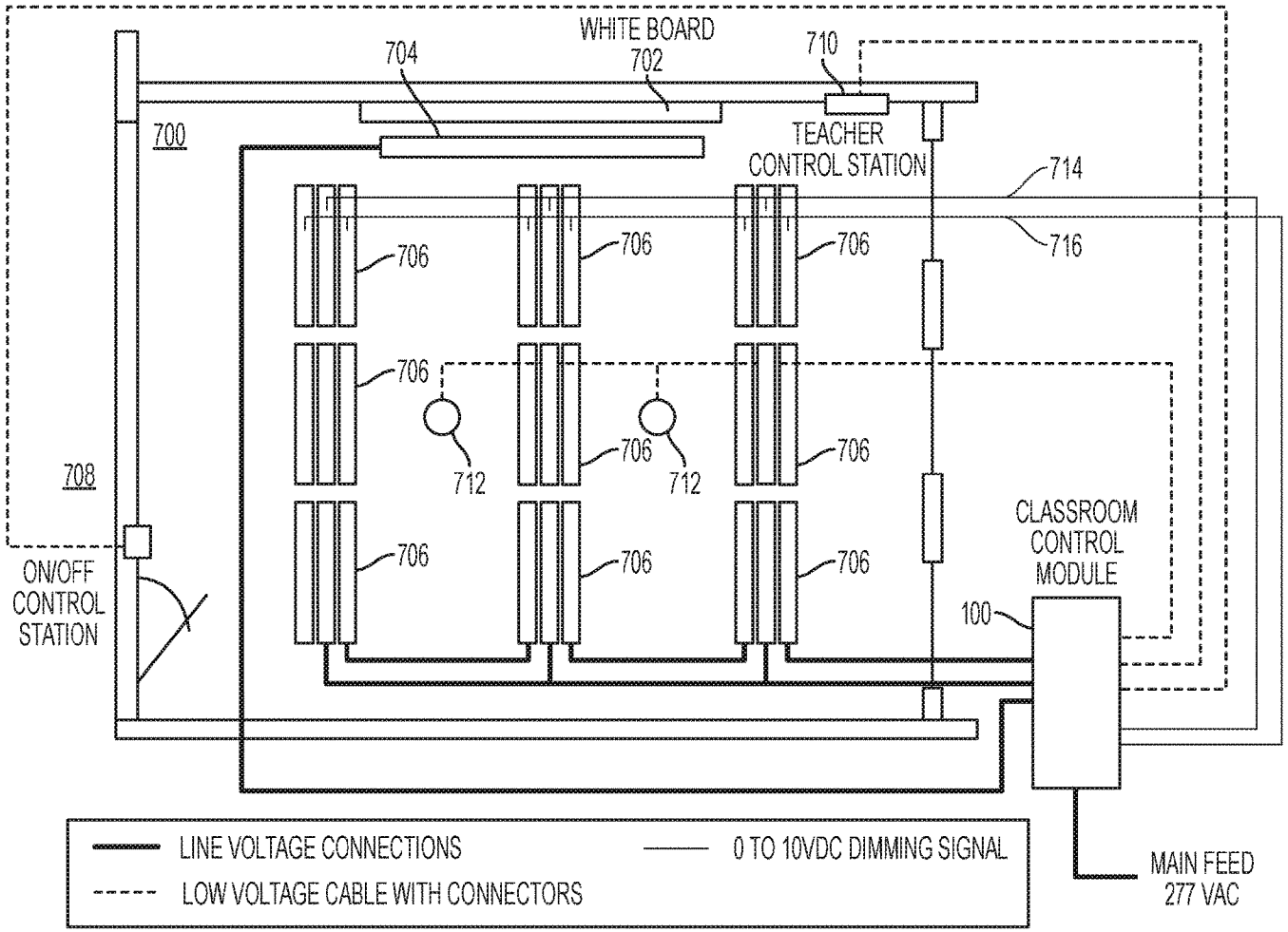
Figure 8A:
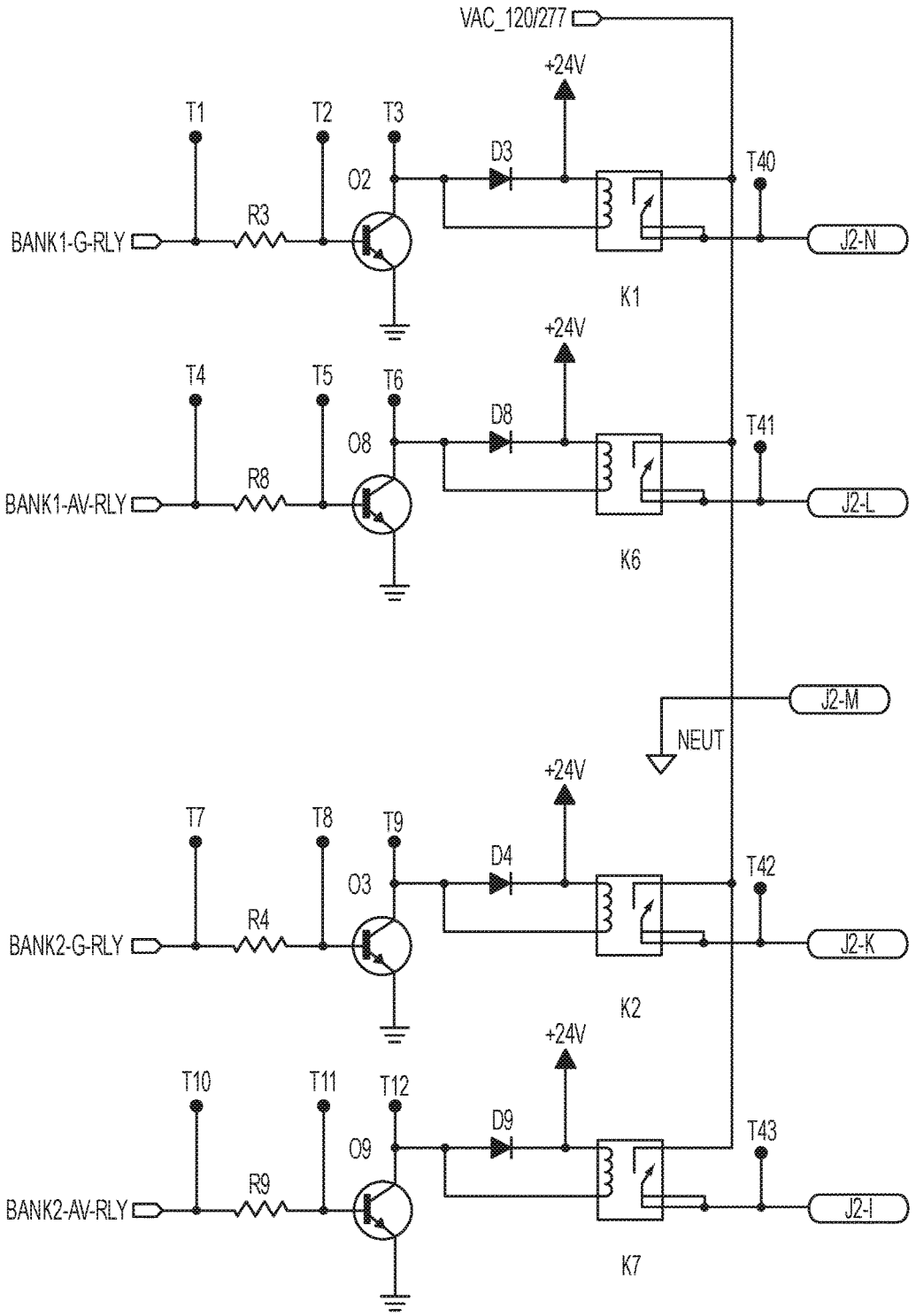
FIGS. 8(*a*)-8(*e*), 9(*a*)-1, 9(*a*)-2, 9(*b*)-1, 9(*b*)-2, 9(*c*)-1, 9(*c*)-2, 9(*d*)-1, 9(*d*)-2, 9(*e*), 9(*f*)-1, 9(*f*)-2, 9(*g*)-1, 9(*g*)-2.
Figure 8B:
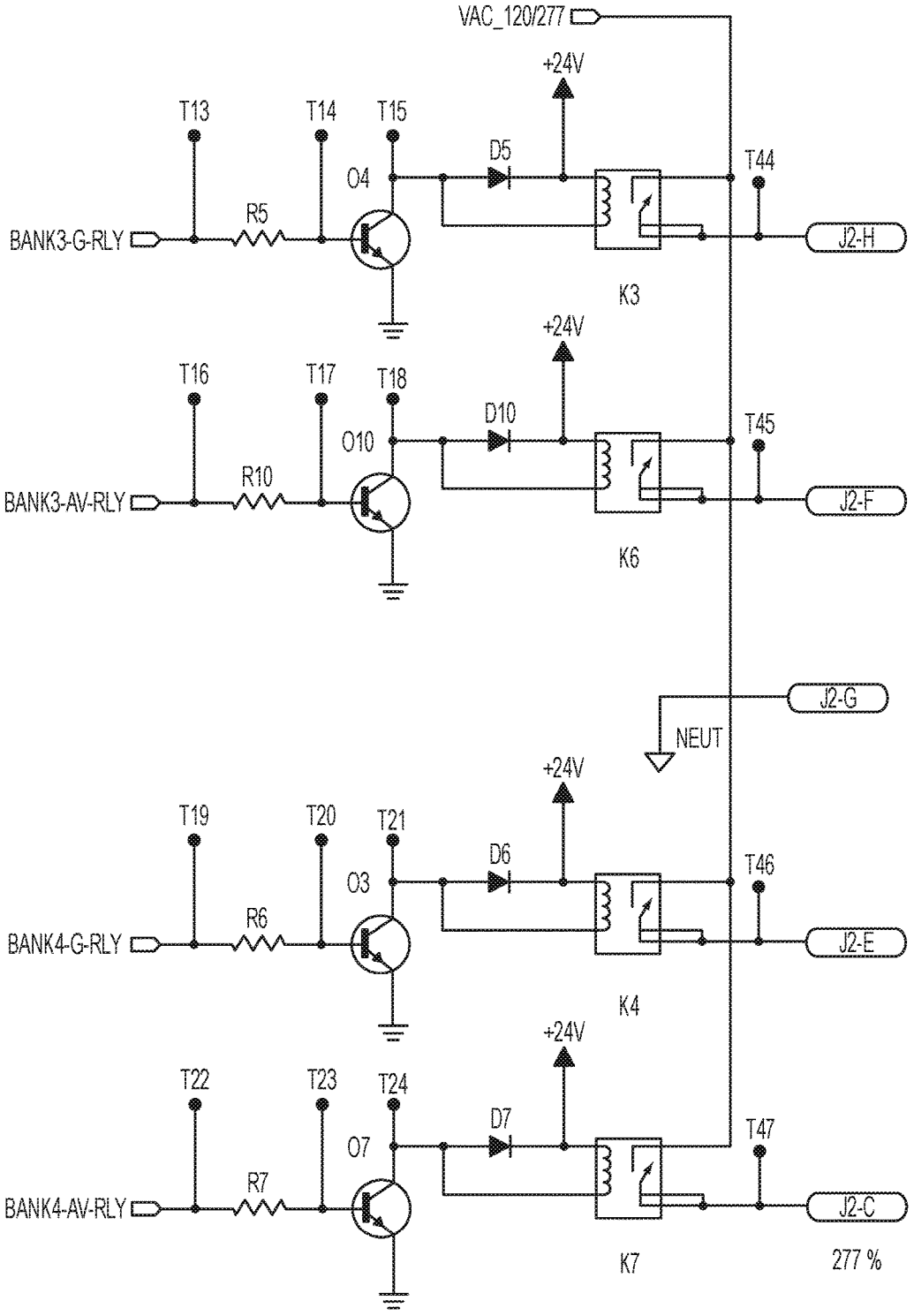
Figure 8C:
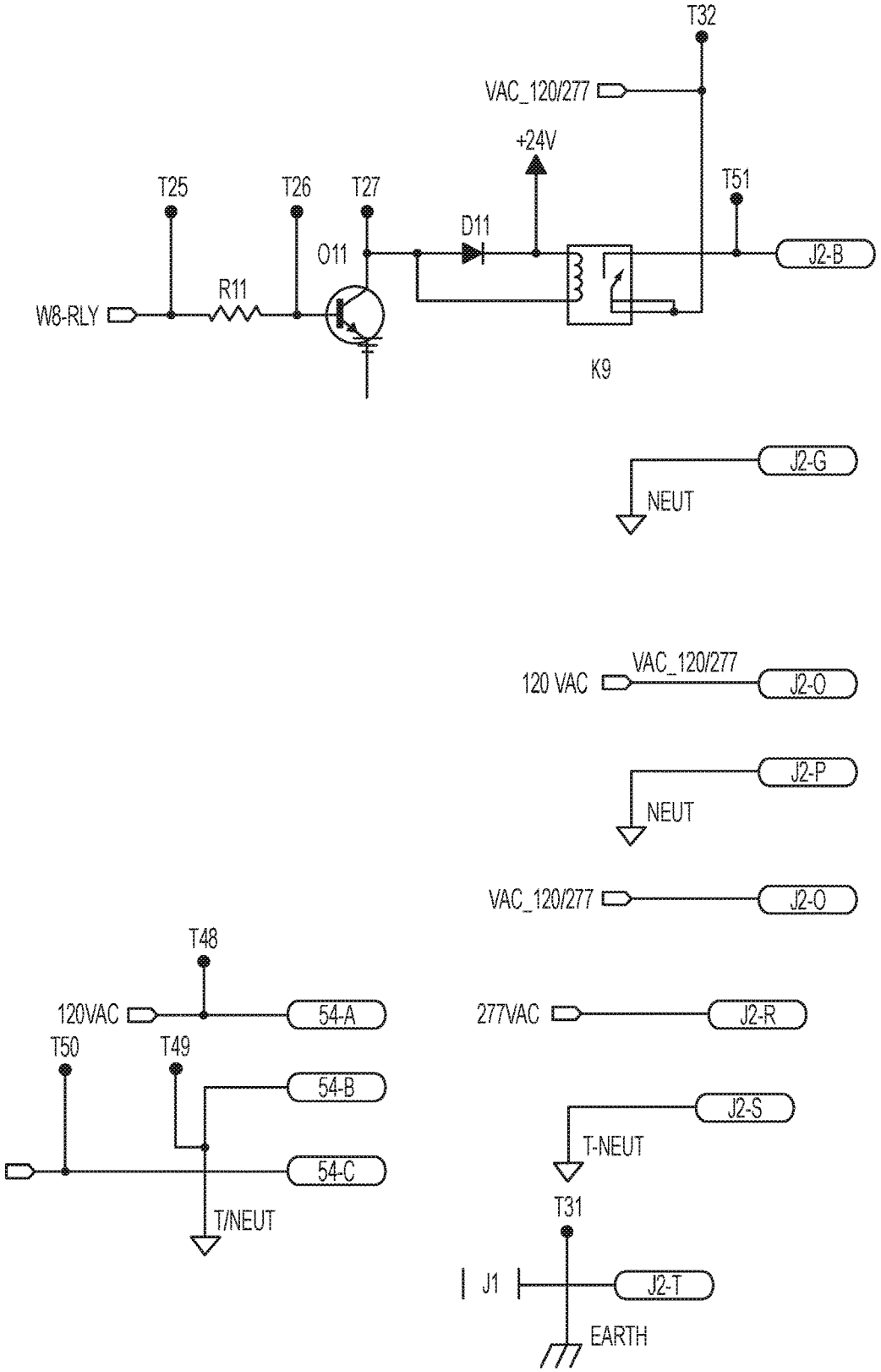
Figure 8D:
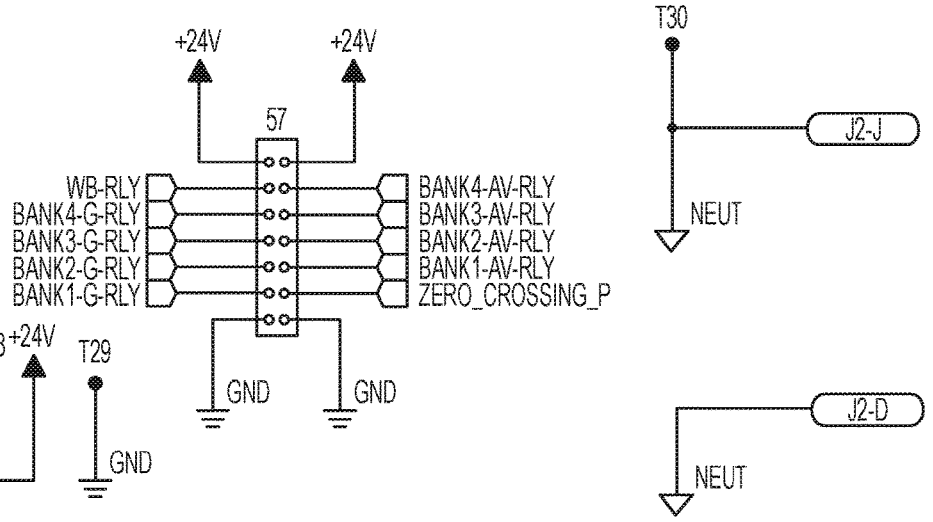
Figure 8E:
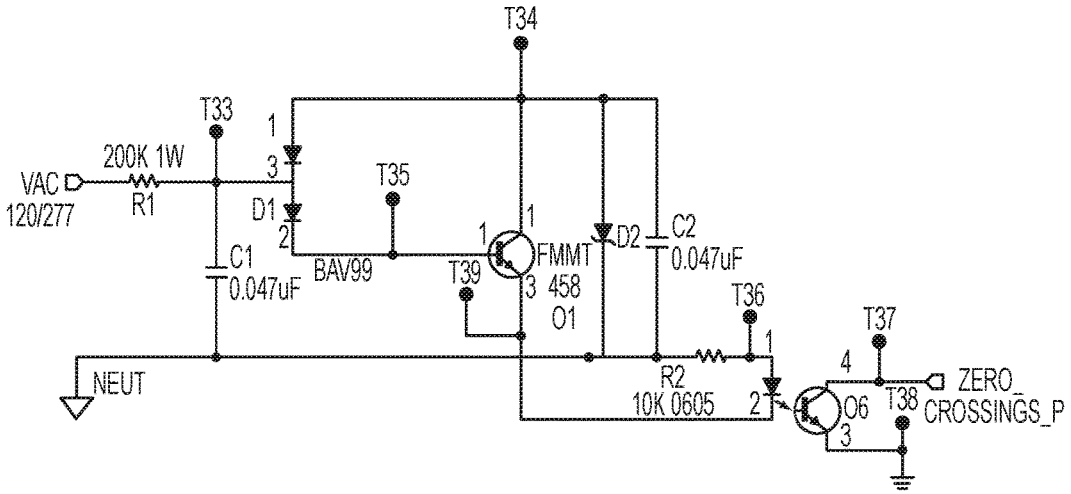
Figures 1, 9A:
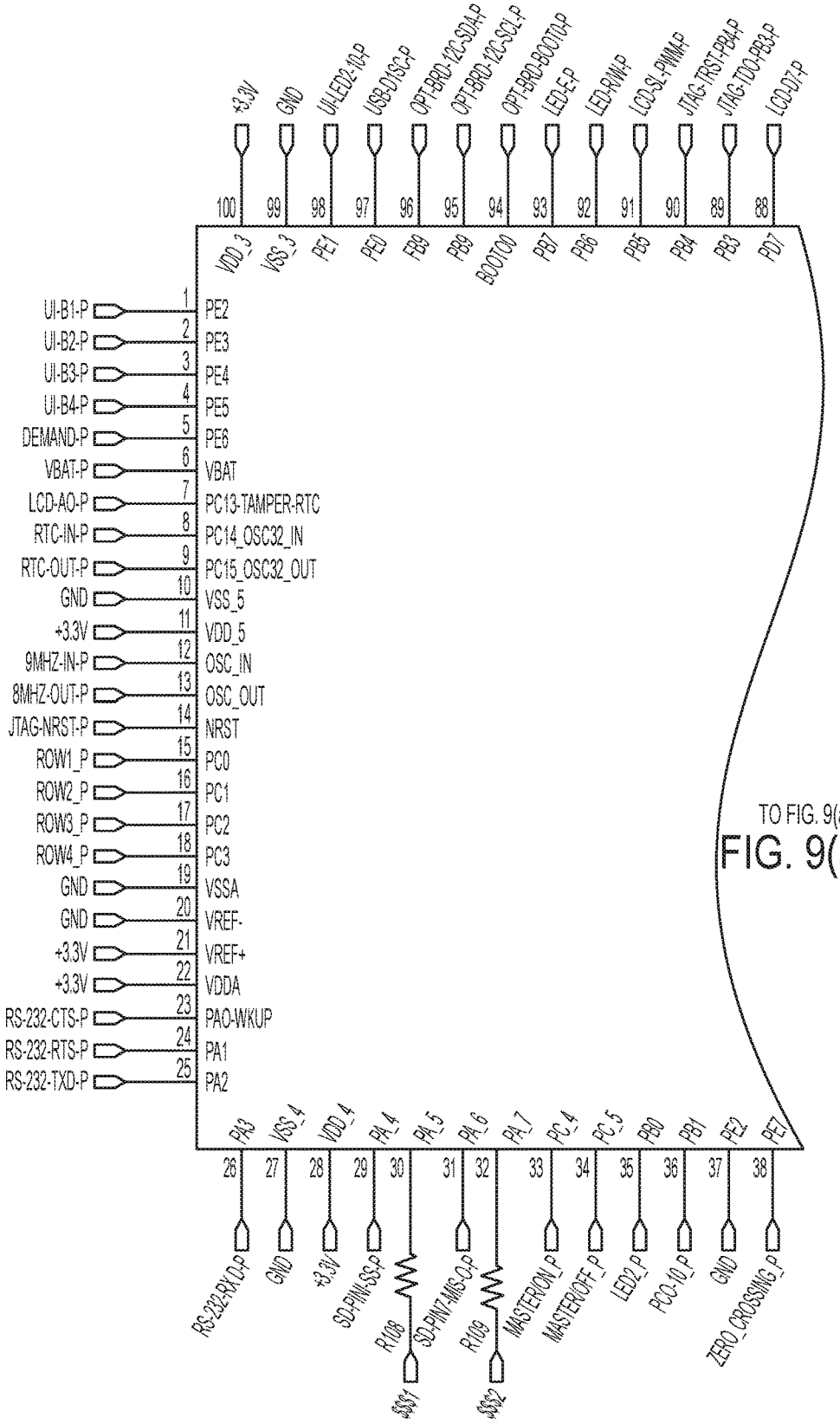
Figures 2, 9A:
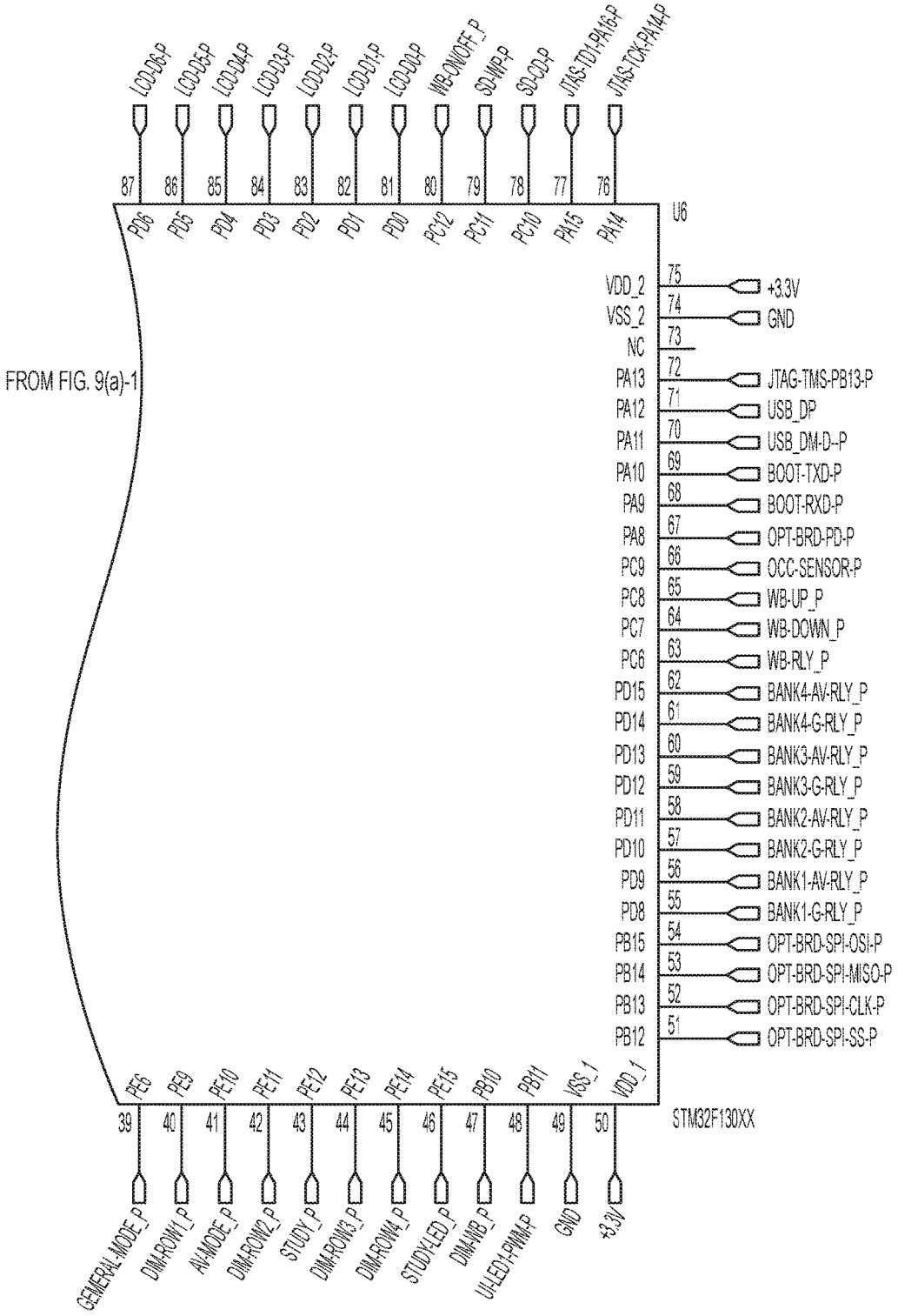
Figures 1, 9B:
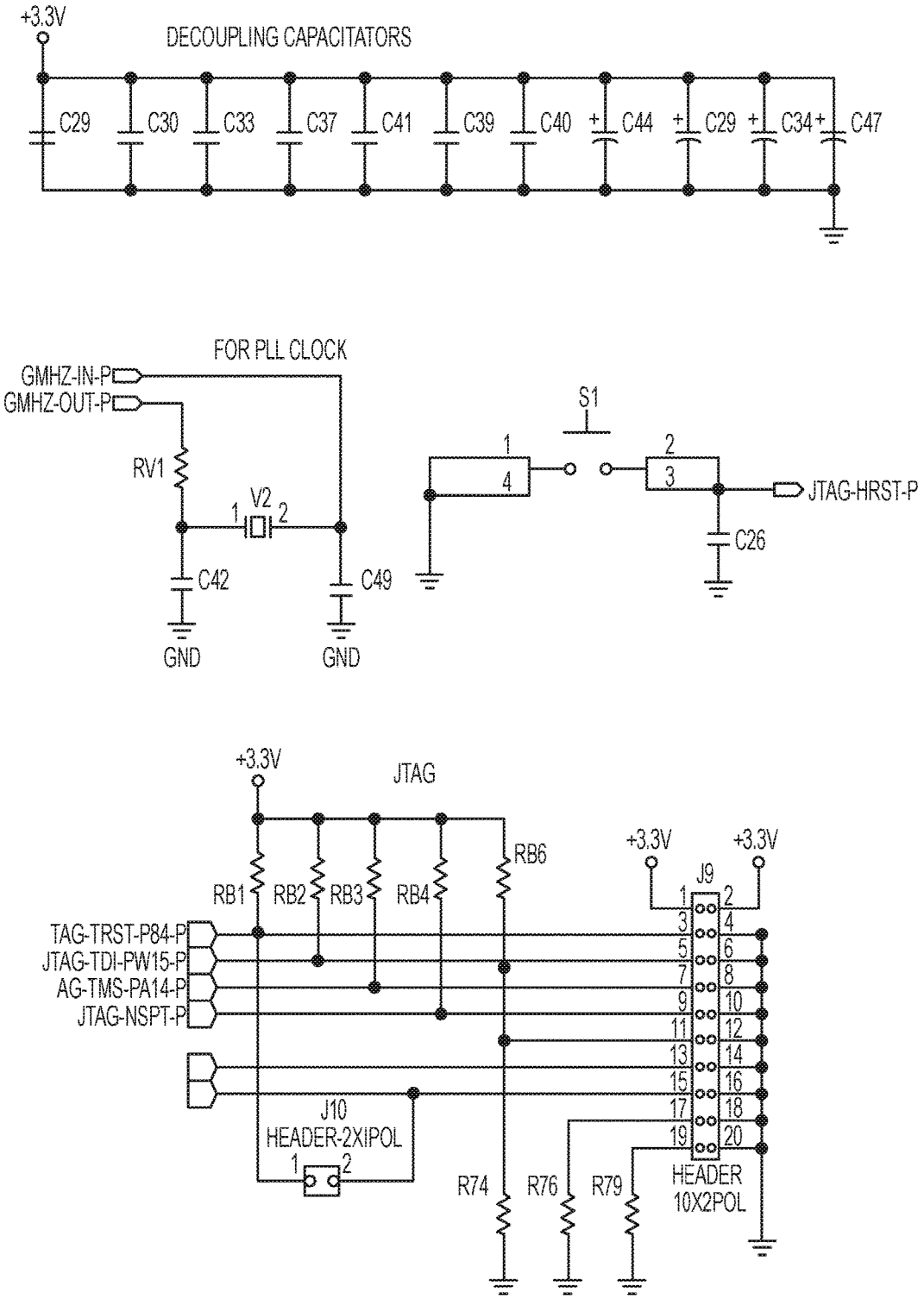
Figures 2, 9B:
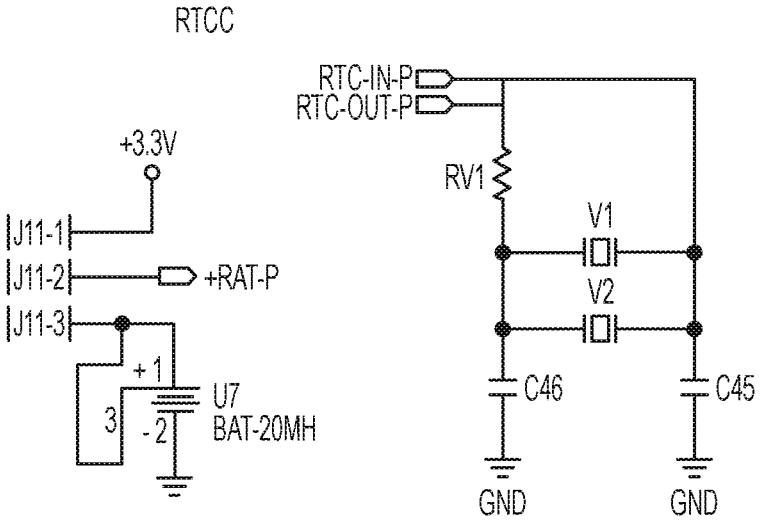
Figures 1, 9C:
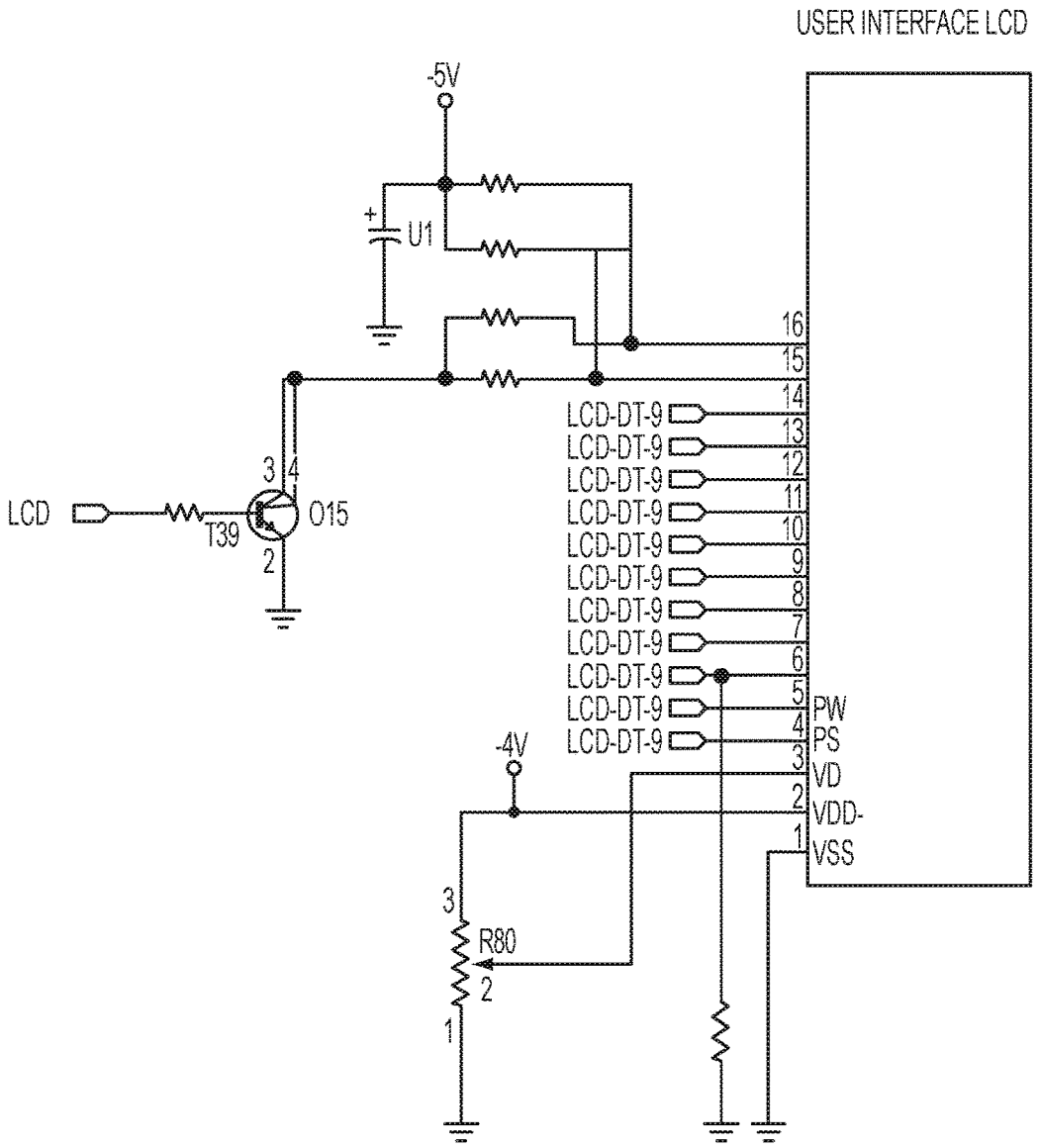
Figures 2, 9C:
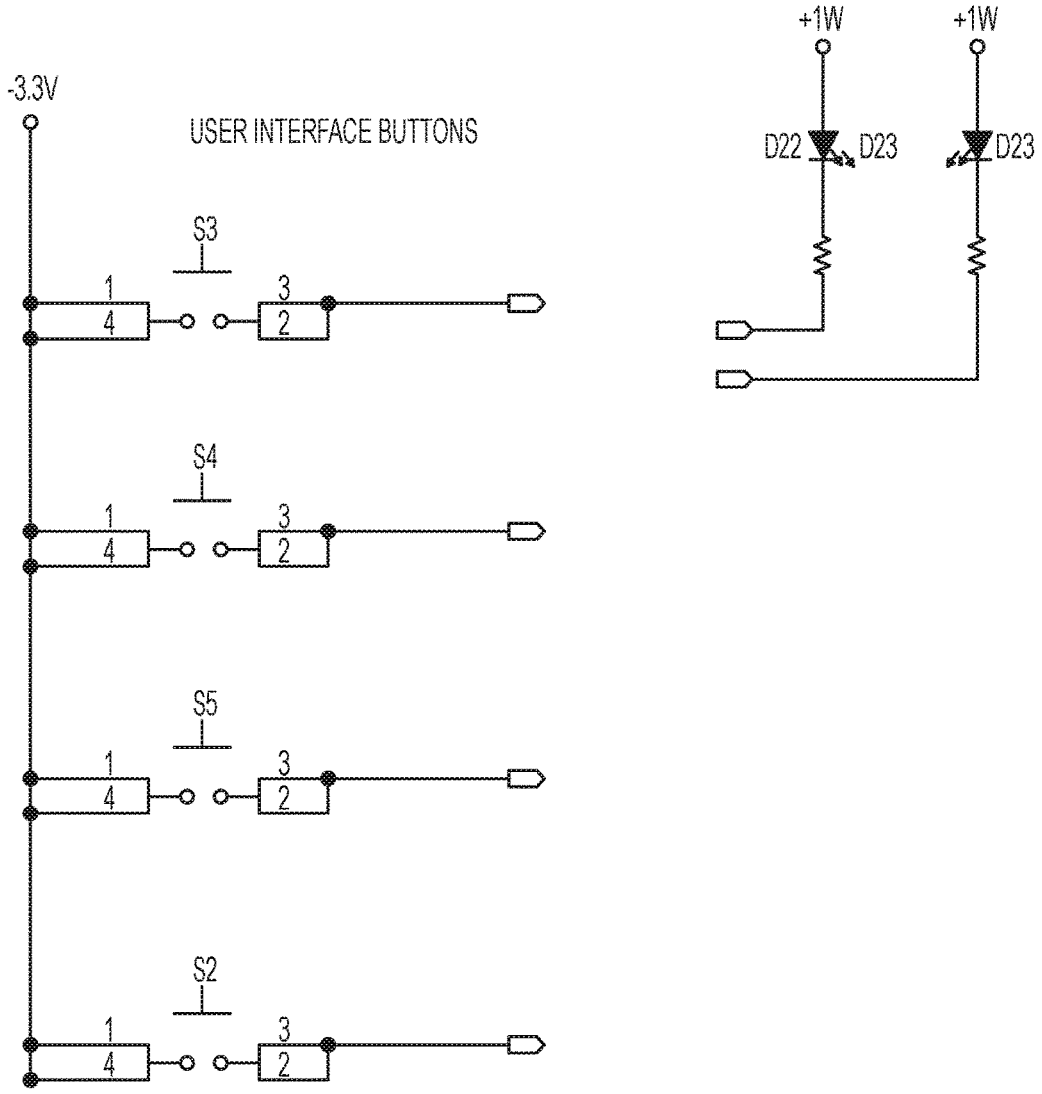
Figures 1, 9D:
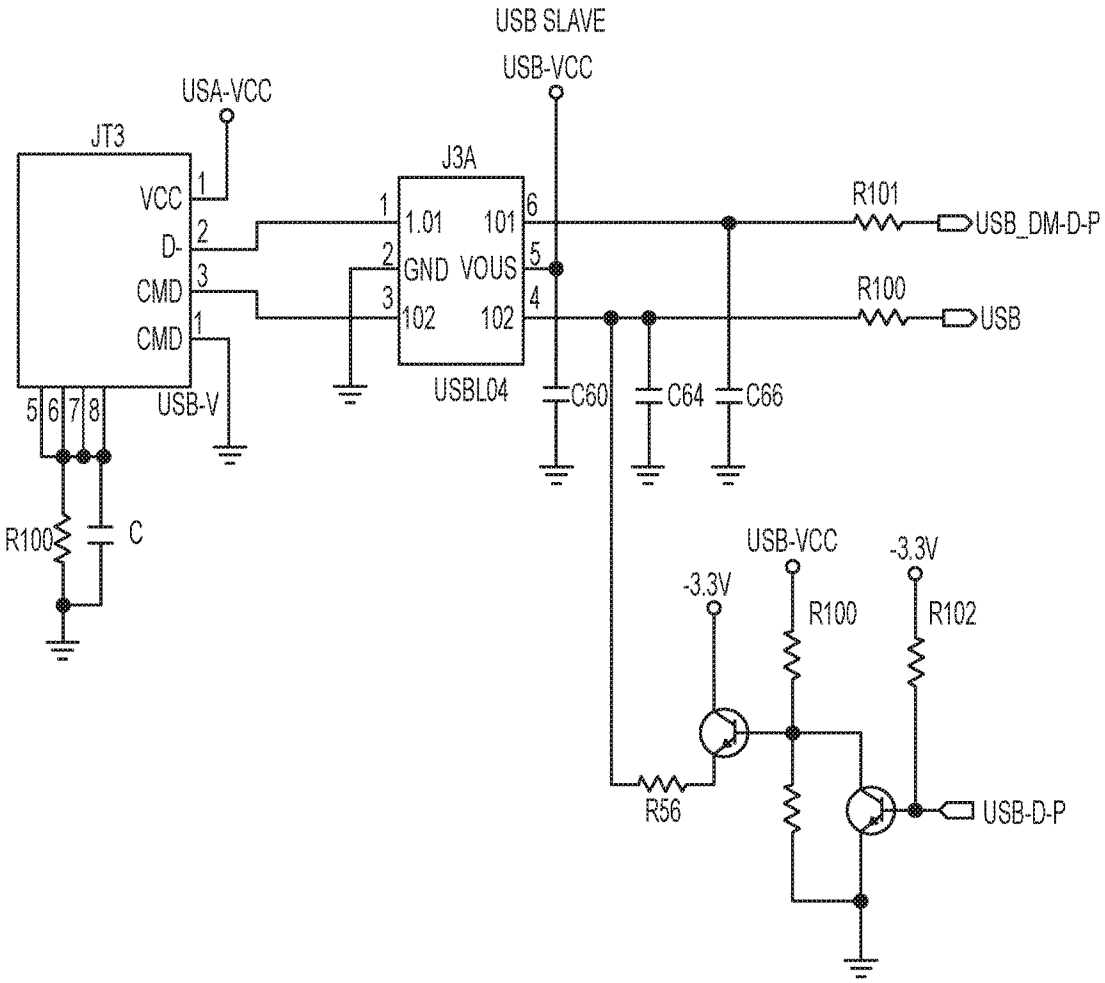
Figures 2, 9D:
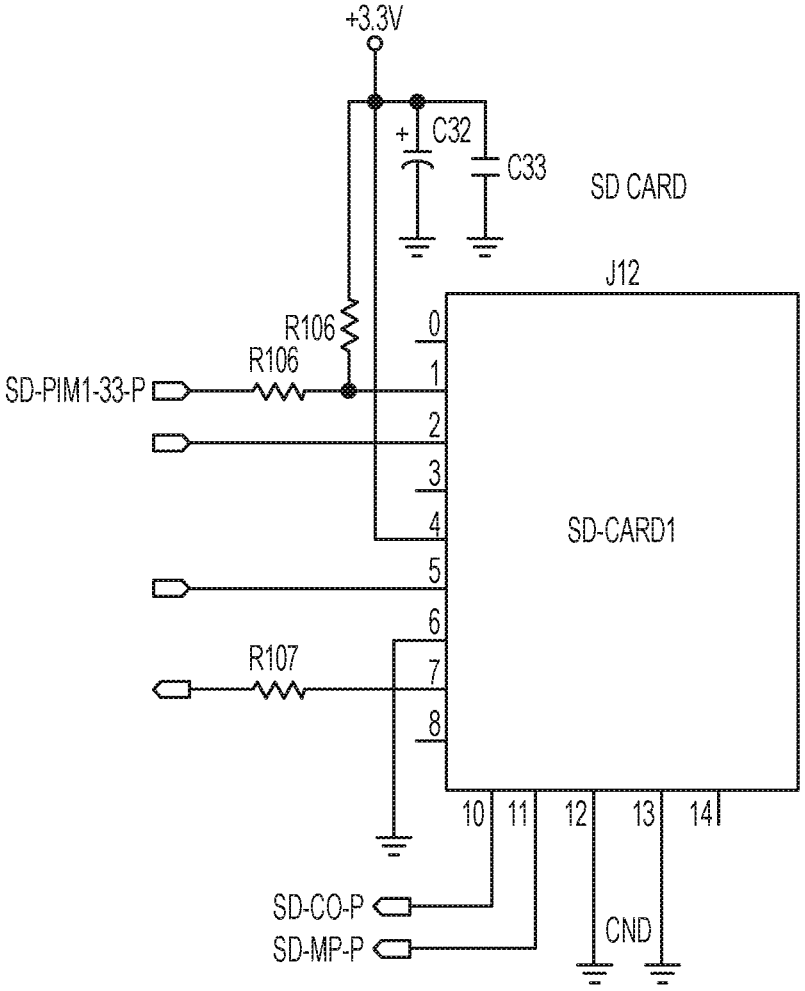
Figure 9E:
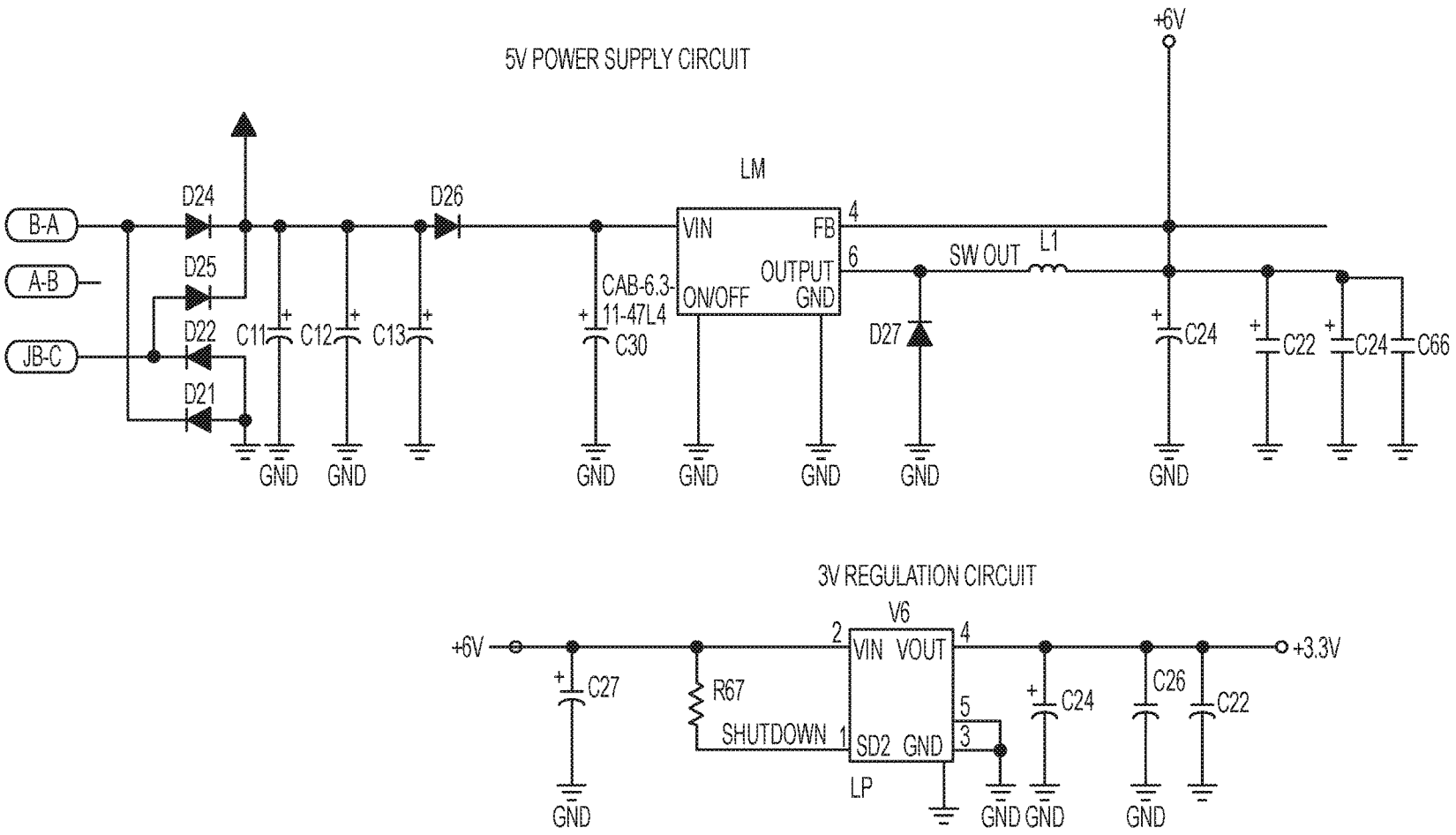
Figures 1, 9F:
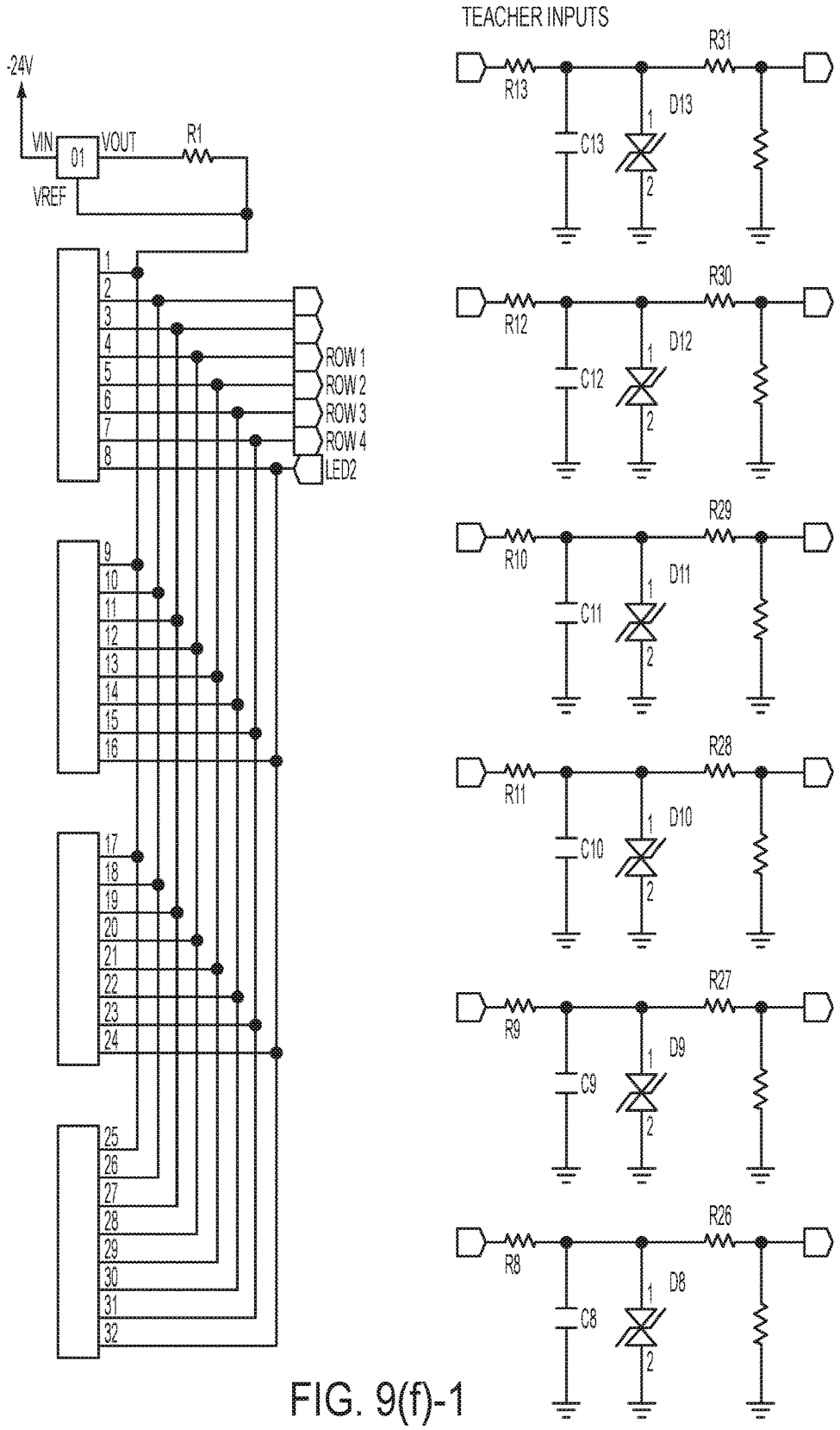
Figures 2, 9F:
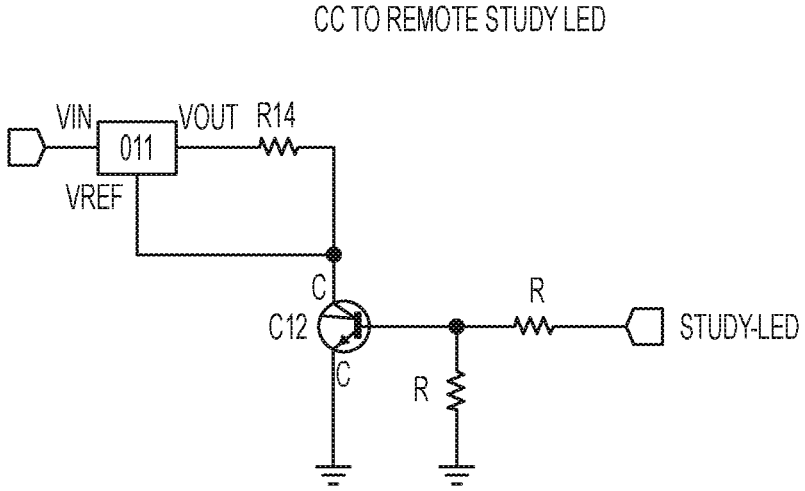
Figures 1, 9G:
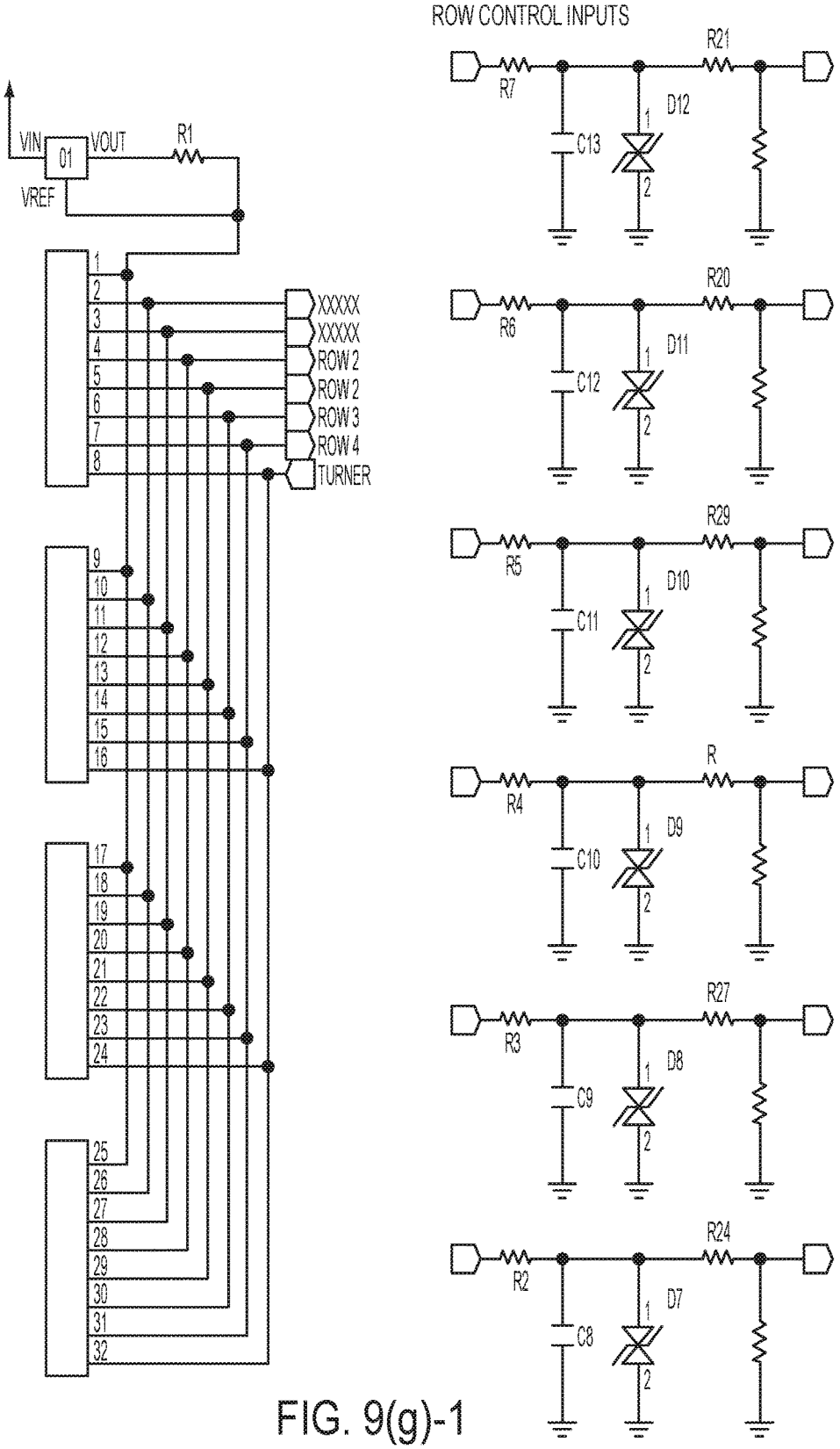
Figures 2, 9G:
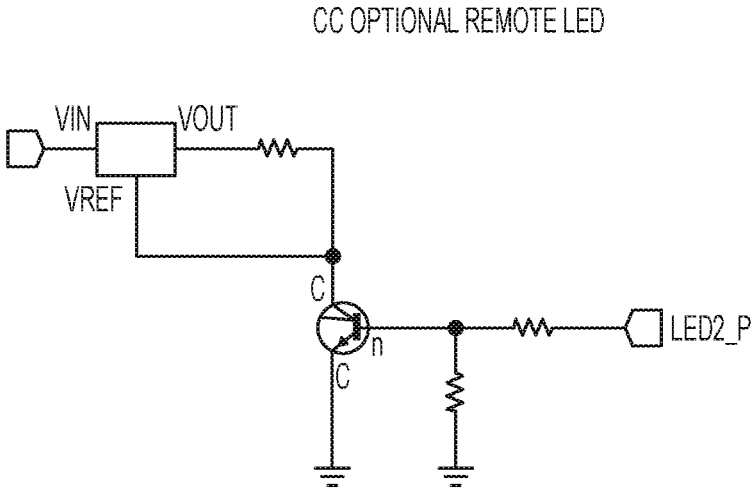
Figures 1, 9H:
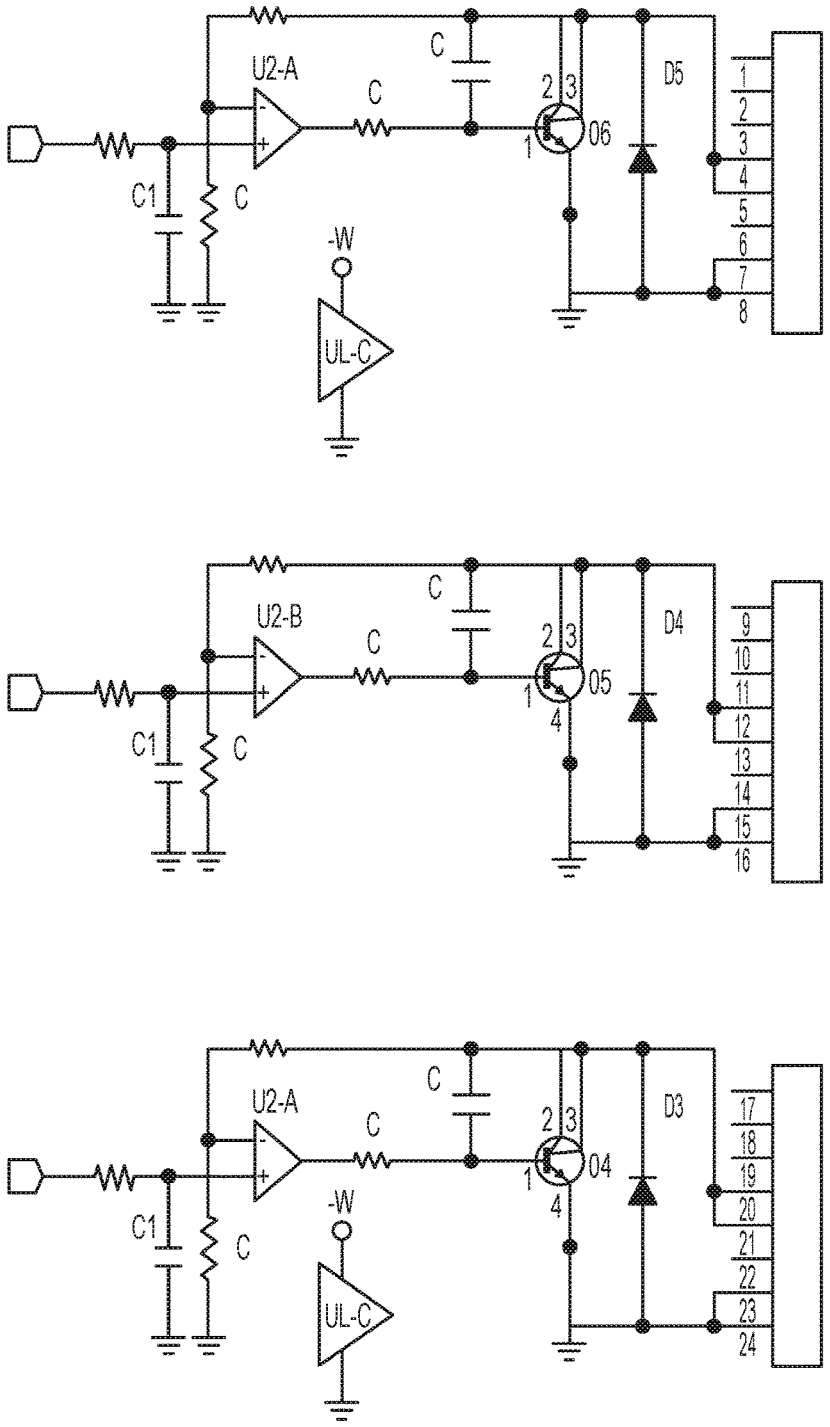
Figures 2, 9H:
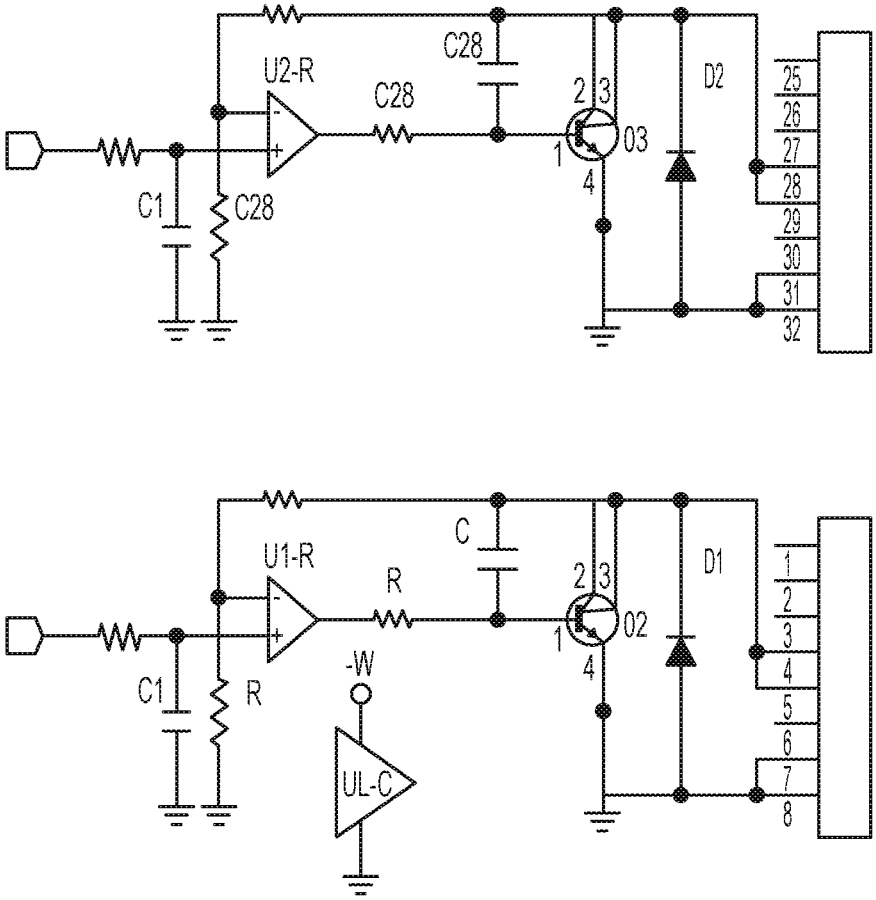
Figure 9I:
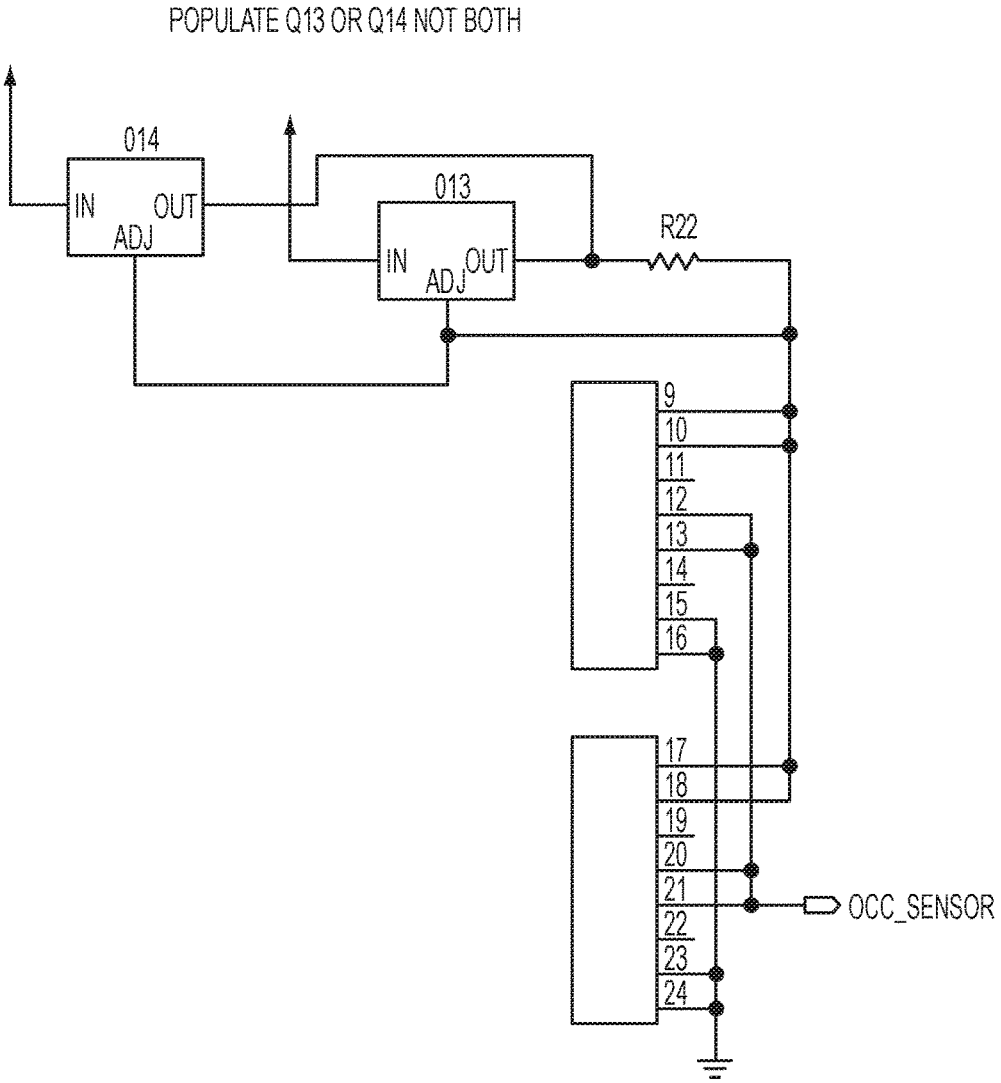
Figure 1:
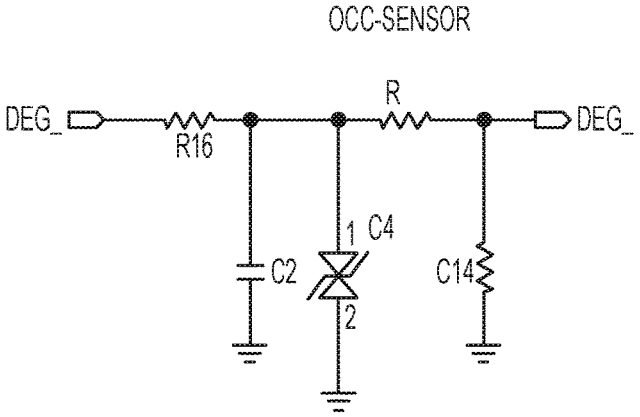
Figures 2, 9I:
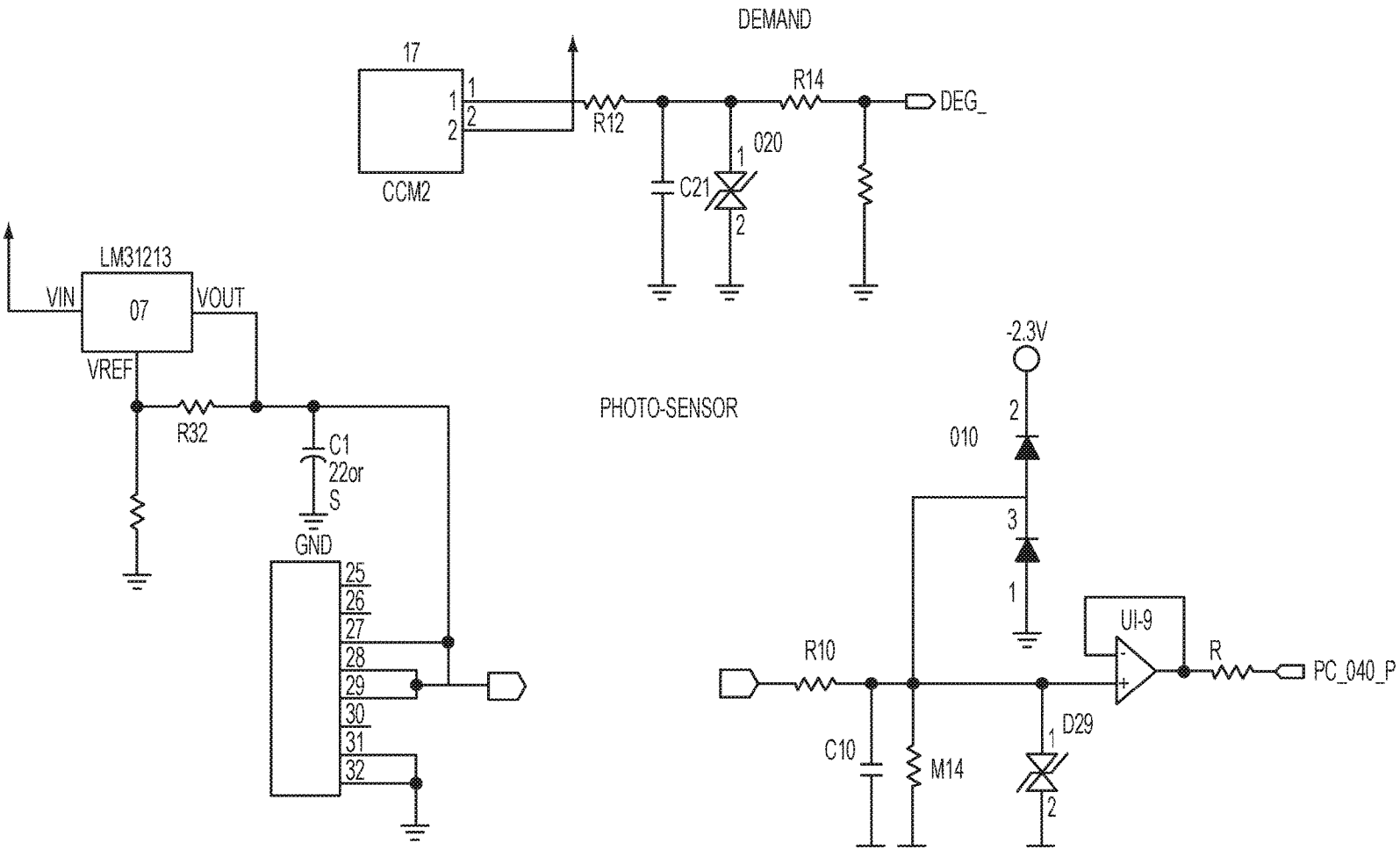
Figure 9I:
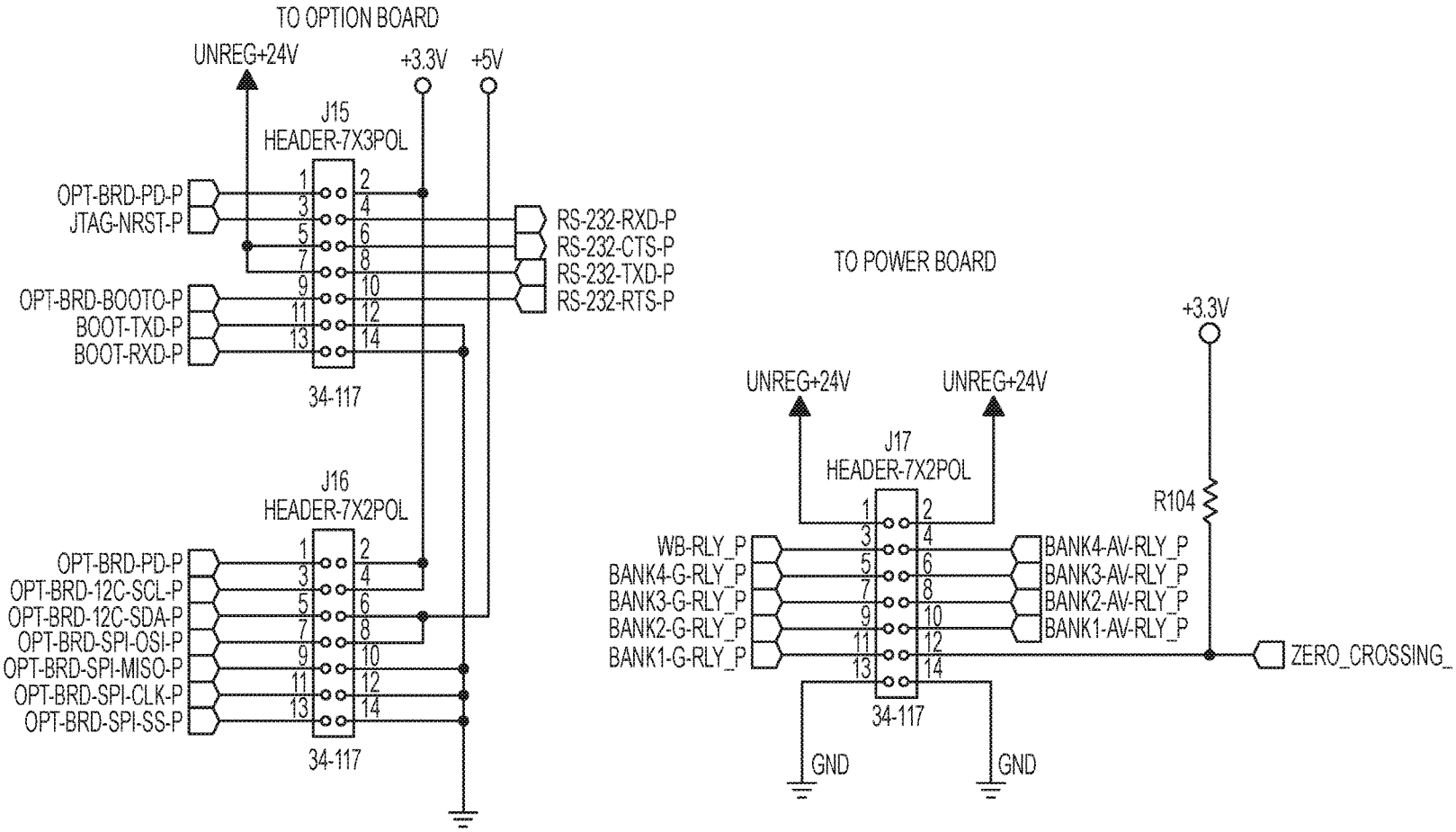

In the example of FIG. 7*c*, the system further provides for general lighting daylight harvesting where an indoor photo sensor 718 provides control information via a dedicated low voltage cable to control module 100 accordingly. Also dimming control is further enhanced by proving dimming signals on line 714 and 716 to rows of fixtures 706. Automatic and manual dimming control, as well as general lighting with A/V dimming and general lighting daylight harvesting have been described above, and are applicable in the implementation of the system illustrated in FIG. 7*c*.

Figure 10A:
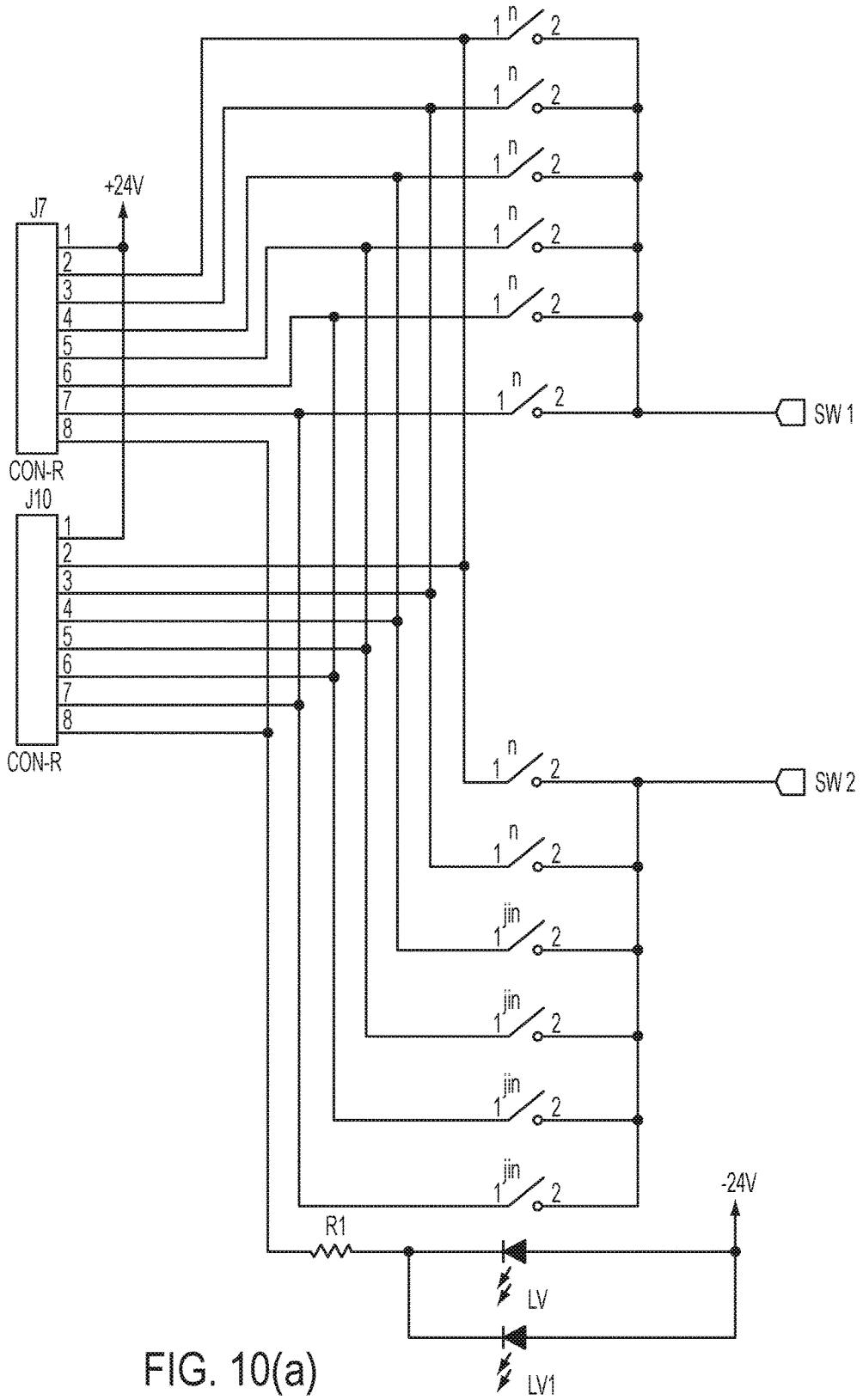
Figure 10B:
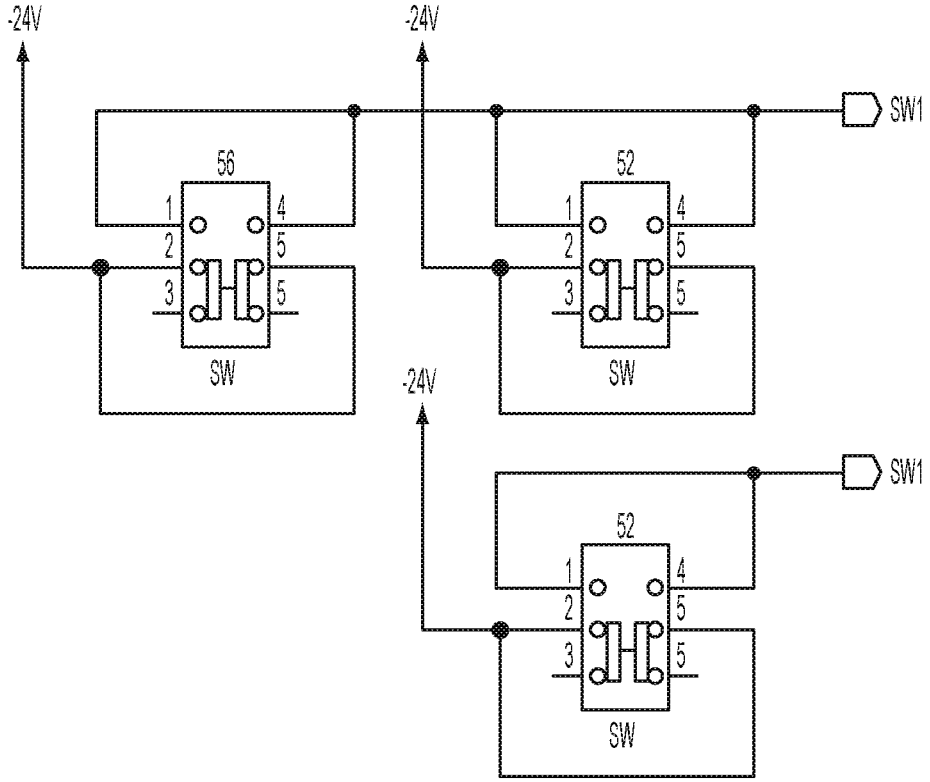

FIGS. 8(*a*) through 10 provide detailed circuit diagrams illustrating exemplary implementations of the various components of systems according to exemplary embodiments of the present invention. For example, FIG. 8(*a*)-8(*e*) illustrate components of a relay board comprising a plurality of electromechanical relays for use in control module 100, as illustrated, for example in FIG. 5. FIG. 9(*a*) generally illustrates a microprocessor for use in a logic control board of controller 100 described above. FIGS. 9(*b*)-9(*j*) include circuit diagrams of various components of the circuit board including: user interface (see FIG. 9(*c*)); USB slave and SD card circuits (see FIG. 9(*d*); power supply and regulation circuits (see FIG. 9(*e*)); various input circuits (see FIGS. 9(*f*) and 9(*g*)); dimming control circuits (see FIG. 9(*h*)); and sensor circuits (see FIG. 9(*i*)). FIG. 10 provides an example of a switch control circuit according to an embodiment of the present invention.

In an advantageous exemplary implementation of certain embodiments of the present invention, a removable SD card can be configured with the controller 100. The SD Card enables, for example:

- Firmware upgrades in the field
- Easy replication of device configuration
- Logging for:
  - debug
  - functional verification
- audit trails for:
  - installation/commissioning setup for LEEDS/CHIPS compliance
  - evidence of energy savings In another advantageous exemplary implementation of certain embodiments of the present invention, when switching among various lighting configurations within a fixture a configuration is provided to ensure the affected area is never completely without light. For example, rather than switching OFF the current configuration, then switch ON the new configuration, which leaves a period of time (e.g., a few seconds with fluorescent lights) when the area is not lit at all, a configuration according to an exemplary embodiment of the present invention facilitates switching ON the new configuration before switching OFF the old one.

Numerous additional modifications and variations of the present invention are possible in light of the above teachings. It is therefore to be understood that within the scope of the appended claims, the present invention may be practiced otherwise than as specifically described herein.

We claim:

1. A control system comprising:

a plurality of high voltage devices grouped into a plurality of zones including a first zone and a second zone;

a plurality of low voltage devices, wherein a first low voltage device is associated with the first zone and a second low voltage device is associated with the second zone; and a central control module including a first low voltage connection for receiving at least one first control signal from at least one of the low voltage devices and a high voltage connection for providing at least one second control signal to at least one of the high voltage devices, the central control module configured to determine a daylight conversion factor based on the at least one control signal, wherein the at least one second control signal is based at least in part on the daylight conversion factor.

2. The system of claim 1 further comprising:

a data interface, coupled to the central control module, wherein the non-transitory computer readable medium is removably coupled to the data interface.

3. The system of claim 1, wherein at least one of the high voltage devices includes a luminaire.

4. The system of claim 1, wherein the central control module further includes a second low voltage connection to at least one of the high voltage devices, and the central control module receives at least one first control signal as input via the at least one first low voltage connection and outputs at least one second control signal via the at least one second low voltage connection.

5. The system of claim 4, wherein the at least one of the high voltage devices includes a light source, and the at least one second control signal is indicative of light level output of the light source.

6. The system of claim 1 comprising a plurality of high voltage connections, wherein the high voltage devices receive high voltage outputs from the high voltage connections, respectively in the zones, the low voltage devices are respectively associated with the zones, and the central control module regulates the high voltage outputs to the high voltage devices in the zones, respectively, based on the input from the low voltage connections associated with the low voltage devices.

7. The system of claim 1, wherein the plurality of low voltage devices includes at least one selected from the group consisting of a control switch, an occupancy detector, and a photocell.

8. A control module comprising:

a line voltage input;

a low voltage section including a controller and a plurality of first low voltage connections; and a high voltage section including a plurality of high voltage connections; and wherein the first low voltage connections receive first control signals as input to the controller, and the controller determines a daylight conversion factor based on the first control signals and regulates the line voltage output on the plurality of high voltage connections based at least in part on the daylight conversion factor and the plurality of high voltage connections control the respective outputs of a plurality of rows of lighting fixtures, wherein the plurality of rows of lighting fixtures include a first row and a second row, and wherein a first low voltage connection is associated with the first row and a second low voltage connection is associated with the second row.

9. The control module of claim 8, wherein the first control signals comprise at least one selected from the group consisting of an ON/OFF signal, a dimming light level signal, an ambient light indication signal, and an occupancy indication signal.

10. The control module of claim 9, wherein the low voltage section further comprises a plurality of second low voltage connections outputting second low voltage control signals.

11. The control module of claim 10, wherein the high voltage connections supply the regulated line voltage to high voltage devices and the second low voltage control signals regulate operation of the high voltage devices.

12. The control module of claim 11, wherein at least one of the high voltage devices includes a luminaire, and at least one of the second low voltage control signals regulates a dimming operation of the luminaire.

13. A lighting control method comprising the steps of:

receiving first low voltage control signals from a plurality of low voltage devices, the plurality of low voltage devices including a first low voltage device and a second low voltage device;

determining, based on the first low voltage control signal, a daylight conversion factor;

providing high voltage outputs, based at least in part on the daylight conversion factor, to a plurality of light fixtures grouped into a plurality of zones, the plurality of zones including a first zone and a second zone, wherein the first low voltage device is associated with the first zone and the second low voltage device is associated with the second; and configuring a control module to process the first low voltage control signals received as input and to regulate the high voltage outputs according to the first low voltage control signals.

14. The method of claim 13, wherein the first low voltage control signals comprise at least one selected from the group consisting of ON/OFF signal, dimming light level signal, ambient light indication signal, and occupancy indication signal.

15. The method of claim 14, further comprising providing a second low voltage control signal to at least one of the light fixtures to affect light level output of the at least one fixture.

16. The method of claim 15, wherein the configuring step further comprises setting the configuration of the control module to output the second low voltage control signals to regulate the operation of the at least one light fixture.

17. The method of claim 16, wherein the second low voltage control signal is indicative of the light level output of the at least one light fixture.

18. The method of claim 13, wherein the non-transitory computer readable medium includes one of a USB device and an SD device.

* * * * *